US008063326B2

(12) United States Patent
Igarashi et al.

(10) Patent No.: US 8,063,326 B2
(45) Date of Patent: Nov. 22, 2011

(54) ILLUMINATING STRUCTURE OF KEY OPERATING UNIT, ELECTRONIC APPARATUS, PORTABLE APPARATUS, AND ILLUMINATING METHOD OF KEY OPERATING UNIT

(75) Inventors: Keisuke Igarashi, Kawasaki (JP); Hiroyuki Uchida, Kawasaki (JP); Naoto Yamashita, Kawasaki (JP); Kazunori Katou, Kawasaki (JP); Toshiyuki Itou, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 12/699,109

(22) Filed: Feb. 3, 2010

(65) Prior Publication Data

US 2010/0181176 A1 Jul. 22, 2010

Related U.S. Application Data

(63) Continuation of application No. PCT/JP2007/066934, filed on Aug. 30, 2007.

(51) Int. Cl.
*H01H 13/83* (2006.01)

(52) U.S. Cl. ..... 200/314; 200/310

(58) Field of Classification Search ..... 200/310–317, 200/341, 516, 517, 5 A; 341/22, 28; 345/168–170; 362/602, 558, 30, 626, 24, 84, 85, 800, 27, 362/228

See application file for complete search history.

(56) References Cited

U.S. PATENT DOCUMENTS 4,551,598 A * 11/1985 Hamilton et al. ..... 200/314
4,772,769 A * 9/1988 Shumate ..... 200/314
5,521,345 A * 5/1996 Wulc ..... 200/317
6,204,459 B1 * 3/2001 Kizele et al. ..... 200/302.1
6,224,221 B1 * 5/2001 Glienicke ..... 362/23
7,230,196 B2 * 6/2007 Toyama ..... 200/314
7,244,899 B2 * 7/2007 Jung et al. ..... 200/314
7,388,167 B2 * 6/2008 Liao et al. ..... 200/310

(Continued)

FOREIGN PATENT DOCUMENTS

JP 2-25124 2/1990

(Continued)

OTHER PUBLICATIONS

English Translation of the International Preliminary Report on Patentability mailed on Mar. 18, 2010 issued in corresponding International Patent Application PCT/JP2007/066934.

(Continued)

*Primary Examiner* — Michael Friedhofer
(74) *Attorney, Agent, or Firm* — Staas & Halsey LLP

(57) ABSTRACT

An illuminating structure of a key operating unit for operating a key switch includes a housing unit to have a window portion formed correspondingly to the key switch, a circuit substrate to be provided inside the housing unit, to be disposed with the key switch, and to be provided with a light-guiding window portion, a keypad unit to include a key top portion inserted in the window portion of the housing unit, the keypad unit including a light-guiding portion at least in the key top portion, a light-emitting element to be arranged on a back surface side of the circuit substrate, and an illuminating plate to have a reflecting portion reflecting outgoing light of the light-emitting element to apply the reflected light from the reflecting portion to the keypad unit through the light-guiding window portion of the circuit substrate.

16 Claims, 21 Drawing Sheets

U.S. PATENT DOCUMENTS

| | | | | |
|---|---|---|---|---|
| 7,705,257 | B2 * | 4/2010 | Arione et al. | 200/314 |
| 7,758,225 | B2 * | 7/2010 | Jung et al. | 362/602 |

FOREIGN PATENT DOCUMENTS

| | | |
|---|---|---|
| JP | 3-40728 | 4/1991 |
| JP | 5-25622 | 4/1993 |
| JP | 5-53071 | 7/1993 |
| JP | 2003-217380 | 7/2003 |
| JP | 2005-174866 | 6/2005 |

OTHER PUBLICATIONS

International Search Report for PCT/JP2007/066934, mailed Nov. 27, 2007.

* cited by examiner

ILLUMINATING STRUCTURE OF KEY OPERATING UNIT, ELECTRONIC APPARATUS, PORTABLE APPARATUS, AND ILLUMINATING METHOD OF KEY OPERATING UNIT

CROSS-REFERENCE TO RELATED APPLICATIONS

This application is a continuation of International Application No. PCT/JP2007/066934, filed on Aug. 30, 2007, now pending, herein incorporated by reference.

FIELD

The embodiments discussed herein are related to an illuminating structure of a key operating unit in a portable apparatus and an electronic apparatus having a plurality of key switches, for example, to an illuminating structure of a key operating unit, an electronic apparatus, a portable apparatus, and an illuminating method of the key operating unit that enable efficient illumination and flattening of the key operating unit.

BACKGROUND

A portable apparatus and an electronic apparatus such as a portable telephone and a portable terminal apparatus include a plurality of key switches and a key operating unit for operating the key switches. The key operation unit is provided with symbol display representative of numbers, characters, etc., assigned to each of the key switches and function display representative of various functions, and an illuminating configuration is used that includes light-emitting elements within a housing to apply light from the inside of the housing such that display contents thereof become recognizable in a dark place to become possible to operate the key operating unit corresponding to the desired key switch.

For such an illuminating configuration, Japanese Laid-Open Patent Publication No. 2005-174866 discloses that a translucent resin key top on the surface of a base sheet and an illumination light source on the rear face of the base sheet are included to form a striped face having heaped stripes in a floodlight area of the illumination light source on the base sheet and that the illuminative property of the resin key top is enhanced since the light transmitting through the base sheet is reflected by the heaped stripes of the striped face and turned back to the inside of the base sheet (Abstract and FIG. 1, etc.).

For example, as depicted in FIG. 1, an illuminating configuration of a key operating unit is arranged with a plurality of key domes 602 housing key switches on the upper surface of a circuit substrate 600 such as a key flexible substrate and is disposed with light-emitting elements 604 between the key domes 602. The upper surface of the circuit substrate 600 is disposed with a keypad 606 covering the key domes 602 and the light-emitting elements 604, and light-transmitting units 608 and light-shielding units 610 are formed on the keypad 606. The symbol display and the function display on the key dome 602 are added to the light-transmitting units 608.

Such an illuminating structure applies direct light 612 of the light-emitting elements 604 from the upper surface of the circuit substrate 600 to the back surface of the keypad 606. Therefore, if an apparatus employing such illuminating structure is miniaturized and the light-emitting elements 604 come closer to the keypad 606, no diffusion is caused in the light emitted from the light-emitting elements 604 until reaching the keypad 606. In this case, since the direct light 612 of the light-emitting elements 604 is concentrated and applied to the back surface of the keypad 606, there occurs inconvenience that the light looks like an eyeball (note: the expression like eyeball and eyeball-like (shape) hereinafter is used as a pattern of a concentric circle due to interfering light) through the keypad 606 and that a uniform light emission (illuminance) is not acquired. Such localized light is impossible to be avoided by a light-shielding member.

If the light-emitting elements 604 come closer to an inner surface of an apparatus housing, there also occurs inconvenience that the light of the light-emitting elements and the light-emitting positions thereof are visible through the housing. To hide such a localized light-emitting position, a light-shielding coating, etc. may be applied or a light-shielding member may be used, and a degree of freedom is reduced in a housing material and a housing structure.

If the direct light of the light-emitting elements is used, an apparatus including a plurality of key operating units may be disposed with the light-emitting elements for the respective key operating units and the number of the disposed light-emitting elements is inconveniently increased.

Such problems are not suggested or disclosed and means for solving them is not disclosed in Japanese Laid-Open Patent Publication No. 2005-174866.

SUMMARY

According to an aspect of the invention, an illuminating structure of a key operating unit for operating a key switch includes a housing unit having a window portion formed correspondingly to the key switch; a circuit substrate provided inside the housing unit, disposed with the key switch, and provided with a light-guiding window portion; a keypad unit that includes a key top portion inserted in the window portion of the housing unit, the keypad unit including a light-guiding portion at least in the key top portion; a light-emitting element arranged on the back surface side of the circuit substrate; and an illuminating plate that has a reflecting portion reflecting outgoing light of the light-emitting element to apply the reflected light from the reflecting portion to the keypad unit through the light-guiding window portion of the circuit substrate.

According to another aspect of the invention, an electronic apparatus having a key operating unit of a key switch includes a housing unit having a window portion formed correspondingly to the key switch; a circuit substrate provided inside the housing unit, disposed with the key switch, and provided with a light-guiding window portion; a keypad unit that includes a key top portion inserted in the window portion of the housing unit, the keypad unit including a light-guiding portion at least in the key top portion; a light-emitting element arranged on the back surface side of the circuit substrate; and an illuminating plate that has a reflecting portion reflecting outgoing light of the light-emitting element to apply the reflected light from the reflecting portion to the keypad unit through the light-guiding window portion of the circuit substrate.

According to another aspect of the invention, a portable apparatus having a key operating unit of a key switch includes a housing unit having a window portion formed correspondingly to the key switch; a circuit substrate provided inside the housing unit, disposed with the key switch, and provided with a light-guiding window portion; a keypad unit that includes a key top portion inserted in the window portion of the housing unit, the keypad unit including a light-guiding portion at least in the key top portion; a light-emitting element arranged on the back surface side of the circuit substrate; and an illuminating plate that has a reflecting portion reflecting outgoing light of the light-emitting element to apply the reflected light from the reflecting portion to the keypad unit through the light-guiding window portion of the circuit substrate.

According to another aspect of the invention, an illuminating method of a key operating unit for operating a key switch includes forming a window portion corresponding to the key switch in a housing unit; disposing the key switch and forming a light-guiding window portion on a circuit substrate provided inside the housing unit; forming a key top portion on a keypad unit for pressing down the key switch and inserting the key top portion in the window portion of the housing unit; arranging a light-emitting element on the back surface side of the circuit substrate; and forming a reflecting portion reflecting outgoing light of the light-emitting element to apply the reflected light acquired by the reflecting portion to the keypad unit through the light-guiding window portion of the circuit substrate.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

Other objects, features and advantages of the present invention will become more apparent by reference to the accompanying drawings and embodiments.

DESCRIPTION OF EMBODIMENTS

One aspect of the embodiments is a structure disposed with a light-emitting element on the back surface side of a circuit substrate including a key switch to reflect light (outgoing light) emitted from the light-emitting element by a reflecting portion of an illuminating plate to illuminate a keypad unit on the upper surface side of the circuit substrate through a light-guiding window portion of the circuit substrate. In this configuration, the outgoing light of the light-emitting element is shielded by the circuit substrate; the reflected light from the reflecting portion of the illuminating plate, i.e., indirect light and diffused light are guided through the light-guiding window portion of the circuit substrate to the keypad unit; a uniform illuminance not acquired from the direct light appears on the keypad unit; what is called eyeball-like light emission appearing on the key operating unit can be prevented; flattening of the illuminating structure is achieved; and the number of the light-emitting elements can be reduced depending on an illuminating range of the reflected light acquired by the reflecting portion.

First Embodiment

Figure 1:
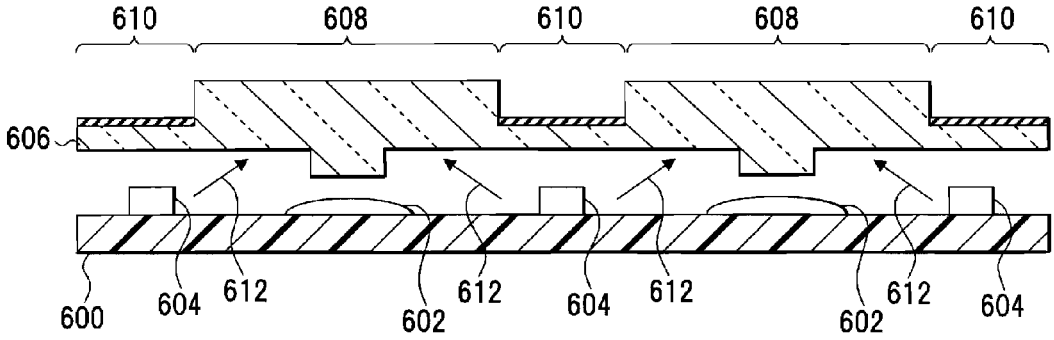
FIG. 1 is a diagram of an illuminating structure of a conventional key operating unit.
Figure 2:
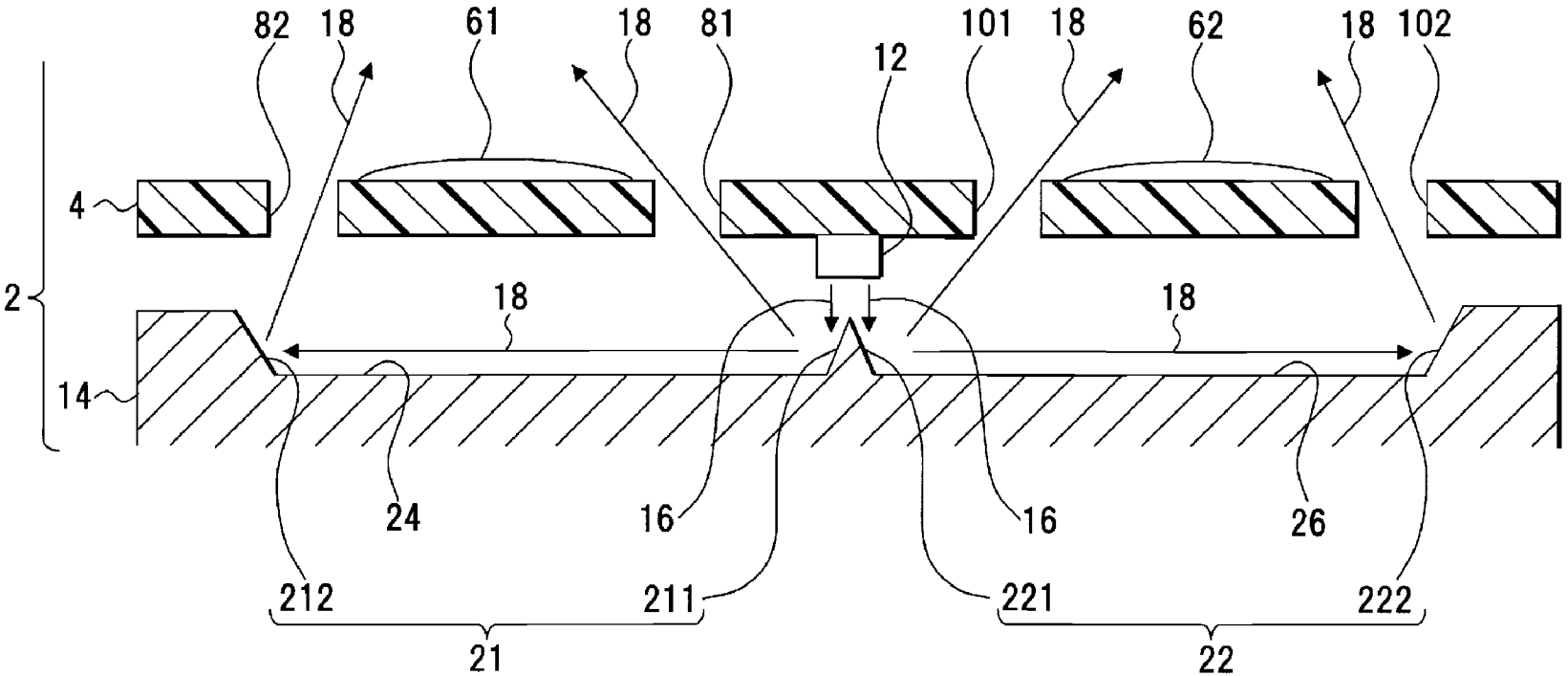
FIG. 2 is a diagram of a first embodiment of an illuminating structure and an illuminating method of a key operating unit.
Figure 3:
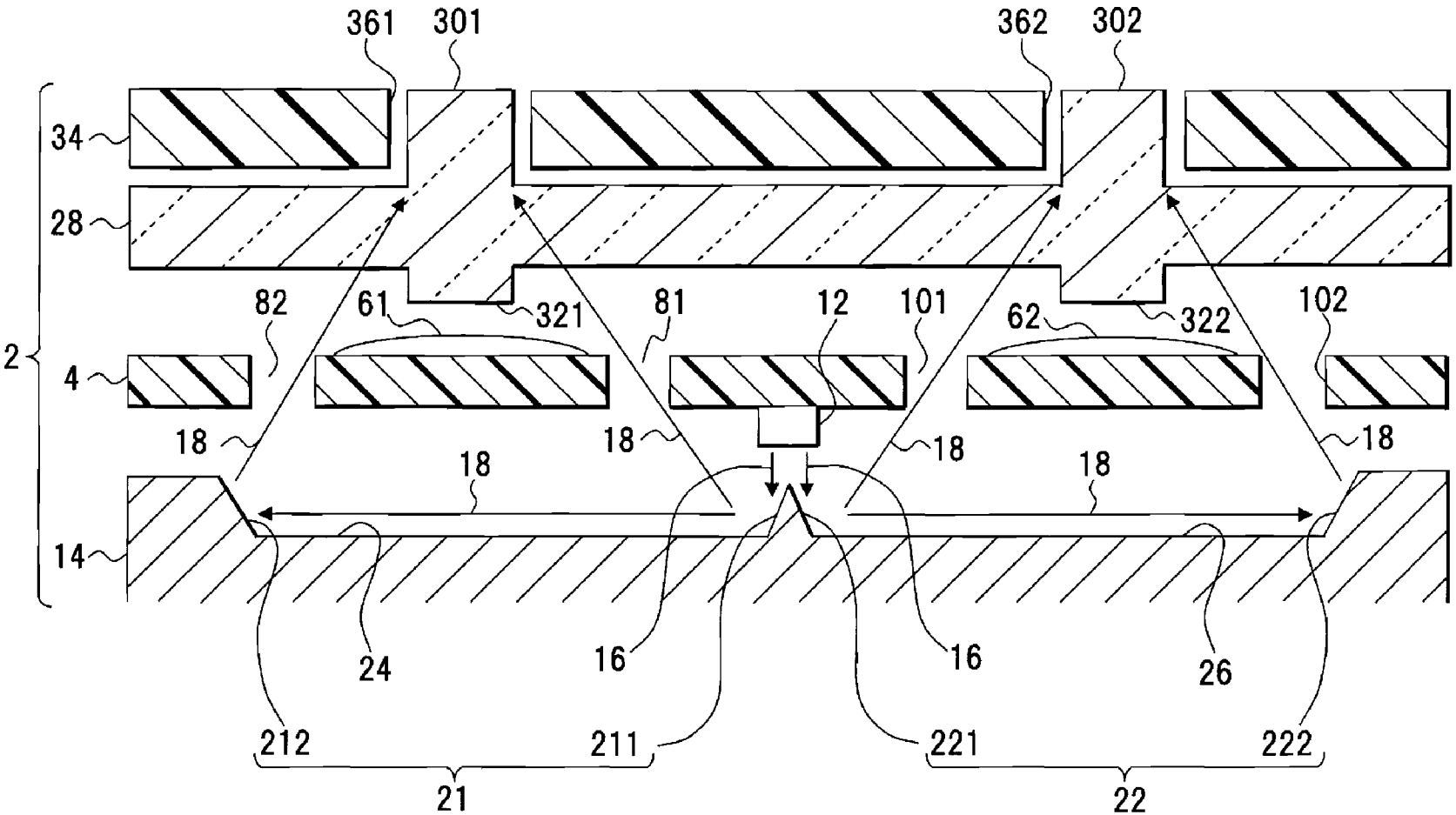
FIG. 3 is a diagram of the illuminating structure of the key operating unit including a housing unit and a keypad unit.

A first embodiment of the present invention will be described with reference to FIGS. 2 and 3. FIG. 2 depicts the first embodiment of an illuminating structure and an illuminating method of a key operating unit and FIG. 3 is a diagram of the illuminating structure of the key operating unit including a housing unit and a keypad unit.

A key operating unit 2 is disposed on a portable apparatus or an electronic apparatus such as a portable telephone disposed with a plurality of key switches and includes a key flexible substrate (hereinafter, "key-flexible") 4 as a circuit substrate. The key-flexible 4 is disposed with key domes 61 and 62 as the key switches, and light-guiding window portions 81 and 82 and light-guiding window portions 101 and 102 are formed sandwiching the key dome 61 and the key dome 62, respectively. Each of the key domes 61 and 62 houses a key switch. Since the light-guiding window portions 81, 82, 101 and 102 are light-guiding means transmitting and guiding the light from the back surface side of the key-flexible 4 to the front surface side of the key-flexible 4, the light-guiding window portions only need light-guiding property and may be sealed by a transparent material, etc.

The back surface side of the key-flexible 4 is disposed with a light-emitting element 12. In this embodiment, the light-emitting element 12 is disposed at the center portion between the adjacent light-guiding window portions 81 and 101, and the key dome 61 and the light-guiding window portions 81 and 82, and the key dome 62 and the light-guiding window portions 101 and 102 are symmetrically arranged on the right and left side relative to the light-emitting element 12. The light-emitting element 12 is an example of a light source and may be made up of, for example, LED (light emitting diode), or may be another type of light source.

An illuminating plate 14 is disposed as an illuminating member on the back surface side of the key-flexible 4. The illuminating plate 14 is an example of illuminating means and receives and reflects an outgoing light 16 of the light-emitting element 12 to apply a reflected light 18 to the upper surface side of the key-flexible 4. Therefore, in this embodiment, a reflecting portion 21 on the side of the key dome 61 and a reflecting portion 22 on the side of the key dome 62 are formed as a plurality of reflecting portions receiving and reflecting the outgoing light 16 to acquire the reflected light 18. In this embodiment, the reflecting portion 21 is made up of reflecting surfaces 211 and 212; the reflecting portion 22 is made up of reflecting surfaces 221 and 222; the reflecting portion 21 is formed as a trapezoidal recess portion 24 on the upper surface of the reflecting plate 14; and the reflecting portion 22 is formed as a trapezoidal recess portion 26 on the upper surface of the reflecting plate 14. The reflecting plate 14 is made of a metal plate or a synthetic resin plate and the reflecting portions 21 and 22 are formed by a plate surface of the metal plate or a metal plating process, metal deposition, etc., for the synthetic resin plate to form mirror finished surfaces on the reflecting surfaces 211, 212, 221 and 222.

The reflecting surface 211 is a sloped surface guiding the reflected light 18 to the light-guiding window portion 81 and the reflecting surface 212, and the reflecting surface 212 is a sloped surface guiding the reflected light 18 mainly to the light-guiding window portion 82. The reflecting surface 221 is a sloped surface guiding the reflected light 18 to the light-guiding window portion 101 and the reflecting surface 222, and the reflecting surface 222 is a sloped surface guiding the reflected light 18 mainly to the light-guiding window portion 102.

In this configuration, the outgoing light 16 emitted from the top portion of the light-emitting element 12 (downward in FIG. 2) is reflected by the reflecting surface 211; one side of the reflected light 18 is guided through the light-guiding window portion 81 to the upper surface side of the key-flexible 4; and the other side of the reflected light 18 is reflected by the reflecting surface 212 on the opposite side and applied through the light-guiding window portion 82 to the upper surface side of the key-flexible 4. A key top portion 301 is illuminated by the reflected light 18 and emits light on a housing unit 34 as depicted in FIG. 3. The outgoing light 16 of the light-emitting element 12 is reflected by the reflecting surface 221; one side of the reflected light 18 is guided through the light-guiding window portion 101 to the upper surface side of the key-flexible 4; and the other side of the reflected light 18 is reflected by the reflecting surface 222 on the opposite side and applied through the light-guiding window portion 102 to the upper surface side of the key-flexible 4. A key top portion 302 is illuminated by the reflected light 18 and emits light on the housing unit 34.

A keypad unit 28 disposed on the upper side of the key-flexible 4 has the key top portions 301 and 302 formed on the upper side at the positions corresponding to the key domes 61 and 62 and has projecting portions 321 and 322 formed on the lower side at the positions corresponding to the key domes 61 and 62 for pressing down the key domes 61 and 62. The key top portions 301 and 302 and the projecting portions 321 and 322 are light-guiding portions for transmitting or guiding light and are made of a light-transmitting material that transmits light or a light-guiding material that guides light.

A plurality of window portions 361 and 362 are formed in the housing unit 34 correspondingly to the key switches. The key top portion 301 of the keypad unit 28 is inserted in the window portion 361 and the key top portion 302 is inserted in the window portion 362. The top portions of the key top portions 301 and 302 are conformed to the outer surface portion of the housing unit 34. The inside of the housing unit 34 is made of, for example, a synthetic resin having a light-shielding property.

In this configuration, since a plurality of the reflecting portions 21 and 22 are included for the single light-emitting element 12, a plurality of the reflected lights 18 can be generated from the outgoing light 16 from the light-emitting element 12 to illuminate the key top portions 301 and 302 over a plurality of the key domes 61 and 62 and this embodiment illuminates a plurality of the key top portions 301 and 302 with the single light-emitting element 12.

Since the light-emitting element 12 is disposed on the back surface of the key-flexible 4, the reflected light, indirect light or diffused light is applied without direct light of the light-emitting element 12 entering the keypad unit 28 and, therefore, the uniform illumination can be acquired for the key operating unit 2. Even if the keypad unit 28 comes closer to the key-flexible 4, what is called an eyeball-like shape is not generated due to the direct light or the deviation of light of the light-emitting element 12.

Since the outgoing light 16 is guided to the illuminating plate 14 in this embodiment, a recess or a reflecting surface can be disposed in the illuminating plate 14 or the disposition thereof is facilitated and the reflected light 18 can indirectly be guided to a portion desired to cause light emission to achieve beautification of appearance by the light.

Since the reflected light 18 acquired from the direct light (outgoing light 16) of the light-emitting element 12 is mainly utilized in this embodiment, the upper surface side of the light-emitting element 12 can be light-shielded by the key-flexible 4 to hide the mounted position of the light-emitting element 12 from the housing unit 34.

The portable apparatus or the electric apparatus equipped with the light-applying structure of the key operating unit uses a shield member formed by deposition to plastic, a metal plate, etc., to take a measure against noise. If such a shield member is used as the illuminating plate 14 in this embodiment, a metal surface of the shield member can be utilized for the reflecting portions 21 and 22 or the reflecting surfaces 211, 212, 221 and 222 and the reflection efficiency of the reflected light 18 can be enhanced by a metal plate or a deposited metal film.

In the above embodiment, the light-emitting element 12 is mounted for the two key domes 61 and 62 and the key top portions 301 and 302 to implement the efficient illumination with the two reflecting portions 21 and 22 and the four reflecting surfaces 211, 212, 221 and 222. In the above embodiment, three or more key switches may be supported by the number of the mounted light-emitting element. That is, in this embodiment, long-range illumination is enabled depending on a reflecting material and a reflecting angle and the number of the mounted light-emitting elements 12, which are the light sources, can be reduced to perform efficient illumination.

Second Embodiment

Figure 4:
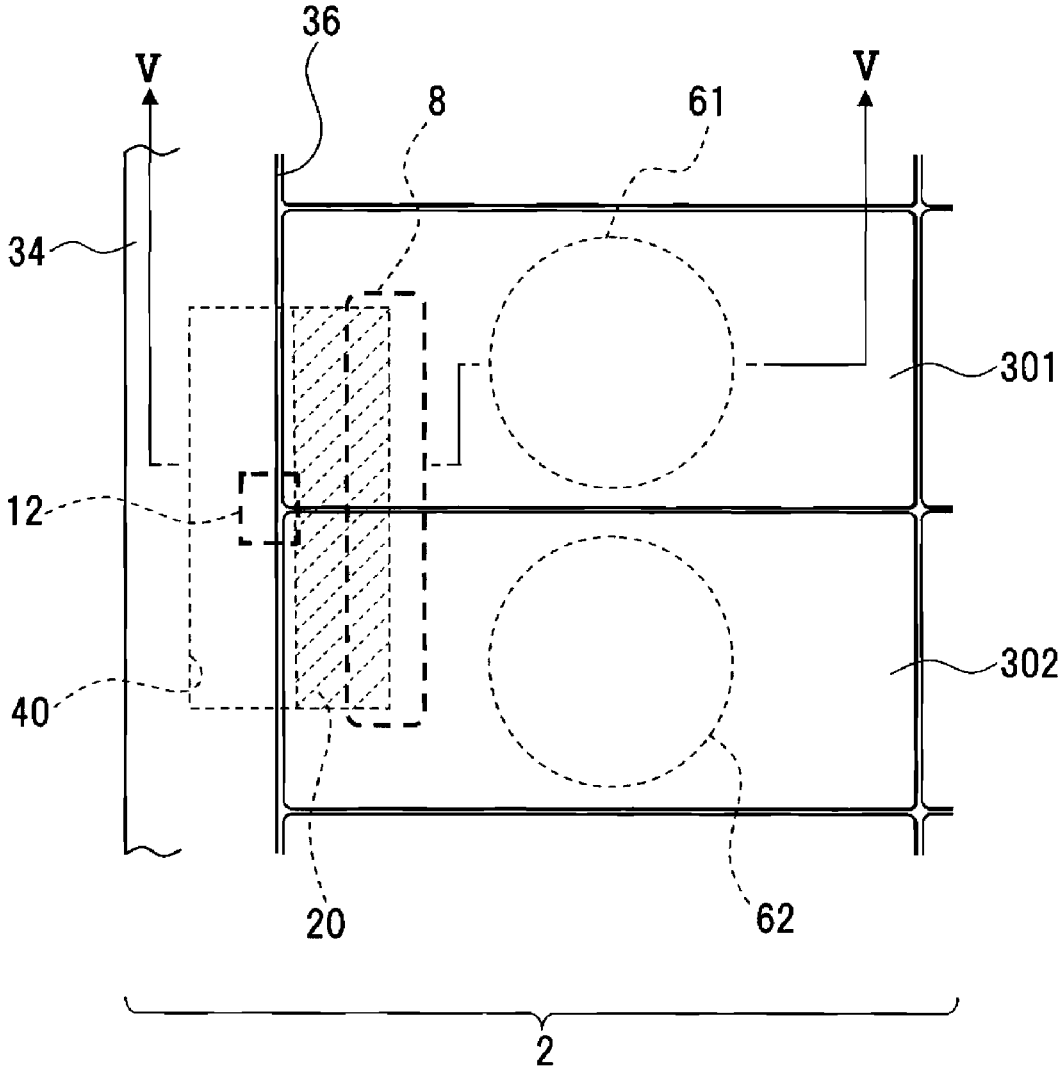
FIG. 4 is a diagram of a second embodiment of an illuminating structure and an illuminating method of a key operating unit.
Figure 5:
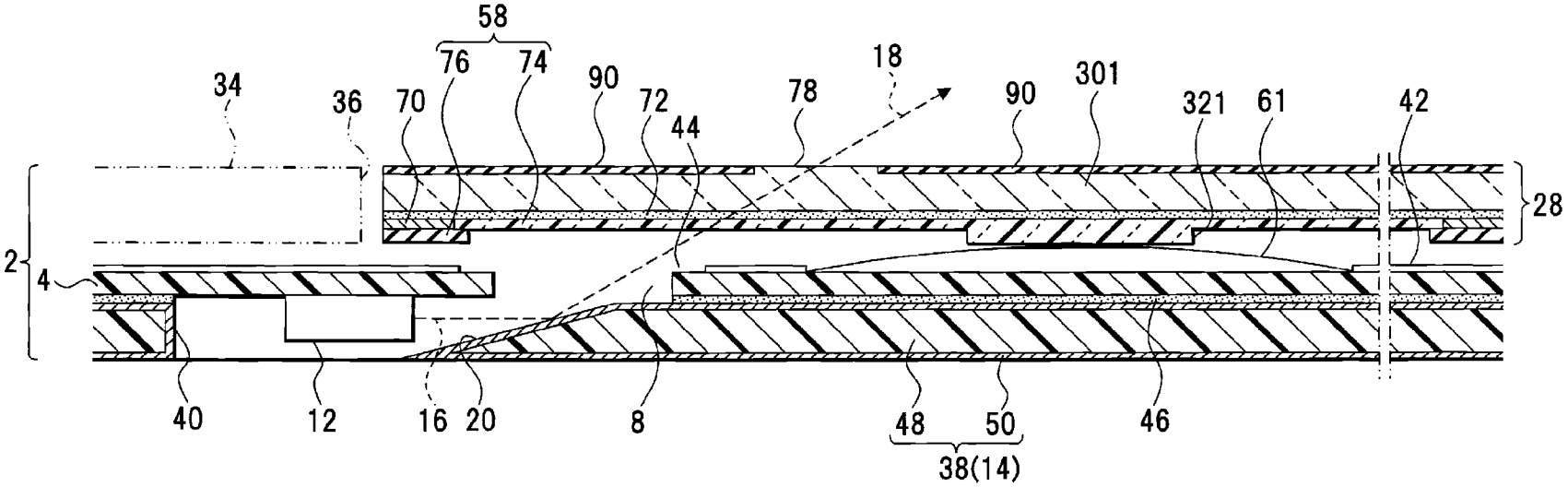
FIG. 5 is a cross-section diagram taken along line V-V of FIG. 4.
Figure 6:
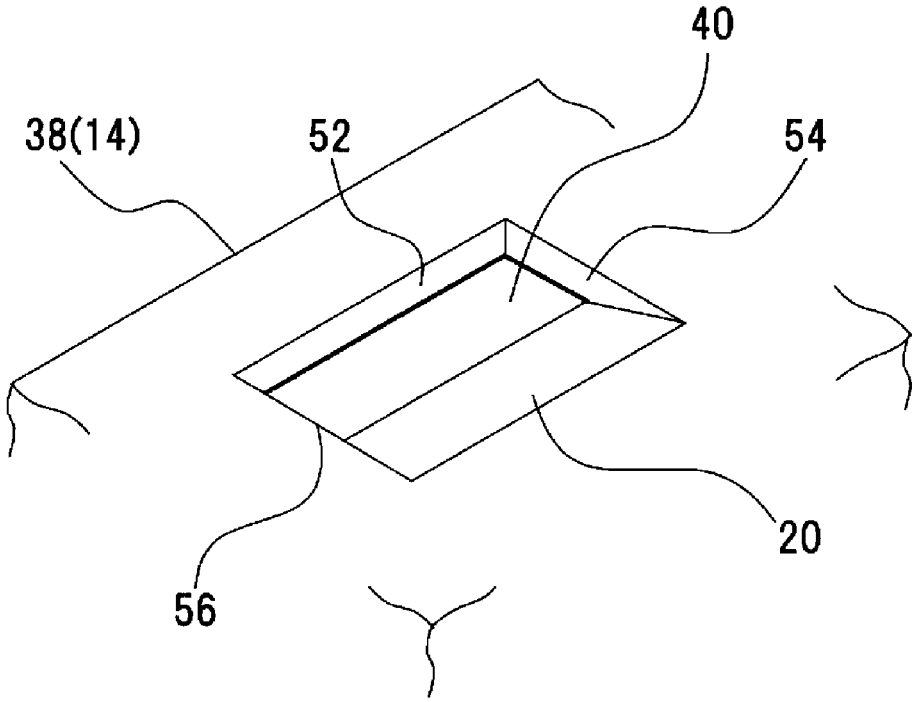
FIG. 6 is a diagram of a recess portion of a shield case unit.

A second embodiment of the present invention will be described with reference to FIGS. 4, 5 and 6. FIG. 4 depicts a key operating unit according to the second embodiment of an illuminating structure and an illuminating method of the key operating unit; FIG. 5 is a cross-section diagram taken along line V-V of FIG. 4; and FIG. 6 depicts a recess portion. In FIGS. 4 to 6, the same portions as FIGS. 2 and 3 are denoted by the same reference numerals.

Although the illumination range is expanded to a plurality of locations by a plurality of the reflecting portions 21 and 22 for the single light-emitting element 12 in the first embodiment, the illumination range is expanded to a plurality of the key top portions 301 and 302 by forming and disposing the single reflecting portion 20 set for the single light-emitting element 12 in an extended manner between a plurality of the key top portions 301 and 302 in the second embodiment. The light-emitting element 12 in this embodiment is the side emission type.

In the key operating unit 2, as depicted in FIG. 4, a window portion 36 formed in the housing unit 34 is disposed with a plurality of the key top portions 301 and 302. A light-guiding window portion 8, the light-emitting element 12, and the reflecting portion 20 across the key top portions 301 and 302 are formed for the key top portions 301 and 302 on the key operating unit 2. The reflecting portion 20 is formed on a wall surface portion of a recess portion 40 formed in a shield case unit 38 (FIG. 5) as the illuminating plate 14 (FIG. 3). With this configuration, the reflected light 18 acquired from the reflecting portion 20 is guided from the common reflecting portion 20 through the light-guiding window portion 8 to the key top portions 301 and 302.

As depicted in FIG. 5, the key operating unit 2 is disposed with a dome sheet 42 including the key dome 61 as a key switch unit on the upper surface of the key-flexible 4 and the light-guiding window portion 8 adjacent to the key dome 61. The dome sheet 42 covers the key dome 61 disposed on the key-flexible 4 and includes, for example, a transparent hole portion 44 as a light-guiding window corresponding to the light-guiding window portion 8. The light-guiding window portion 8 is a through-hole penetrating the key-flexible 4 in the vertical direction to guide the reflected light 18. The edge of the transparent hole portion 44 formed in the dome sheet 42 is retracted from the light-guiding window portion 8 and the opening area of the transparent hole portion 44 is set larger than the light-guiding window portion 8.

The back surface side of the key-flexible 4 is disposed with the light-emitting element 12 as well as the shield case unit 38 and the shield case unit 38 and the key-flexible 4 are bonded by a bonding layer 46. The shield case unit 38 may be a key case unit. In this embodiment, the light-emitting element 12 is disposed near the light-guiding window portion 8 and the light-emitting element 12 projected from the lower surface side of the key-flexible 4 is inserted into the recess portion 40 formed in the shield case unit 38. When the light-emitting element 12 has a height of t1 and the shield case unit 38 has a thickness of t2, since the thickness t2 of the shield case unit 38 is set larger than the height t1 of the light-emitting element 12, the light-emitting element 12 is entirely housed within the recess portion 40 of the shield case unit 38 making up the illuminating plate (FIG. 3).

The shield case unit 38 has a metal layer 50 formed and mirror-finished by coating such as deposition on a surface of abase material unit 48 made of synthetic resin, for example. The recess portion 40 of this embodiment includes direct wall portions 52, 54 and 56 and the reflecting portion 20. The outgoing light 16 of the light-emitting element 12 is reflected by the reflecting portion 20 and the reflected light 18 therefor is guided through the light-guiding window portion 8 to the upper surface side of the key-flexible 4.

The keypad unit 28 is disposed on the upper surface side of the key-flexible 4 (in the depicted case). In this embodiment, the keypad unit 28 includes a sheet-shaped elastic supporting unit 58 made of, for example, rubber, and a suspension 70 that is an elastic supporting member, and the key top portion 301 corresponding to the key dome 61 is disposed on the upper surface side of the elastic supporting unit 58. The suspension 70 is made of, for example, a metal plate and the elastic supporting unit 58 is disposed on the lower surface side of the suspension 70. The key top portion 301 makes up a numeric key in the case of the portable apparatus, for example. The key top portion 301 and the elastic supporting unit 58 are firmly bonded by a bonding layer made of a bonding material. The bonding layer 72 is made of a light-guiding bonding material.

The elastic supporting unit 58 is made up of a light-transmitting unit 74 made of white synthetic resin, etc., capable of transmitting light at the portion disposed with the key top portion 301 and a light-shielding unit 76 made of black rubber or a light-shielding synthetic resin, etc., at other portions. The projecting portion 321 corresponding to the key dome 61 is formed on the lower surface side of the light-transmitting unit 74.

The key top portion 301 is made of a light-guiding resin subjected to an opaquing process, for example, and includes a light-transmitting portion 78 for displaying a numeric key, a function or a symbol and a light-shielding portion 90. When light is applied to the light transmitting portion 78, the character or symbol thereof is displayed.

The keypad unit 28 has the key top portion 301 formed at the position corresponding to the key dome 61 and the projecting portion 321 for pressing down the key dome 61. In the keypad unit 28, the key top portion 301 and the projecting portion 321 are light-guiding portions for transmitting or guiding light and are made of a light-transmitting material that transmits light or a light-guiding material that guides light.

The outgoing light 16 from a lateral surface side of the light-emitting element 12 disposed on the lower surface side of the key-flexible 4 is reflected by the reflecting portion 20 and the reflected light 18 thereby passes through the light-guiding window portion 8 of the key-flexible 4 and enters the light-transmitting unit 74 of the elastic supporting unit 58 in the keypad unit 28. The key top portion 301 is illuminated by the reflected light 18 passing through the light-transmitting unit 74 and the bonding layer 72 from the lower surface side of the key top portion 31 to display a character, etc., of the light-transmitting portion 78.

Since the key top portion 301 is illuminated by the indirect light and the diffused light diffused by the reflected light 18, the uniform illumination can be acquired without local concentration of light due to the direct light and the conventional eyeball-like shape can be prevented.

The light-emitting element 12 is disposed on the back surface side of the key-flexible 4 and the reflected light 18 for the illumination is formed by the reflecting portion 20 in the recess portion 40, unnecessary leakage of light can be prevented.

Since the light-emitting element 12 is disposed in the recess portion 40 of the key-flexible 4 and hidden within the key-flexible 4, the flattening of the key operating unit 2 is achieved.

Since the light-emitting element 12 is disposed in the recess portion 40 and the outgoing light 16 from the lateral surface side of the light-emitting element 12 can be reflected by the reflecting portion 20 to set the illumination direction, the illumination direction of the reflected light 18 can be set arbitrarily by changing the angle of the reflecting portion 20.

Other Embodiments

Figure 7:
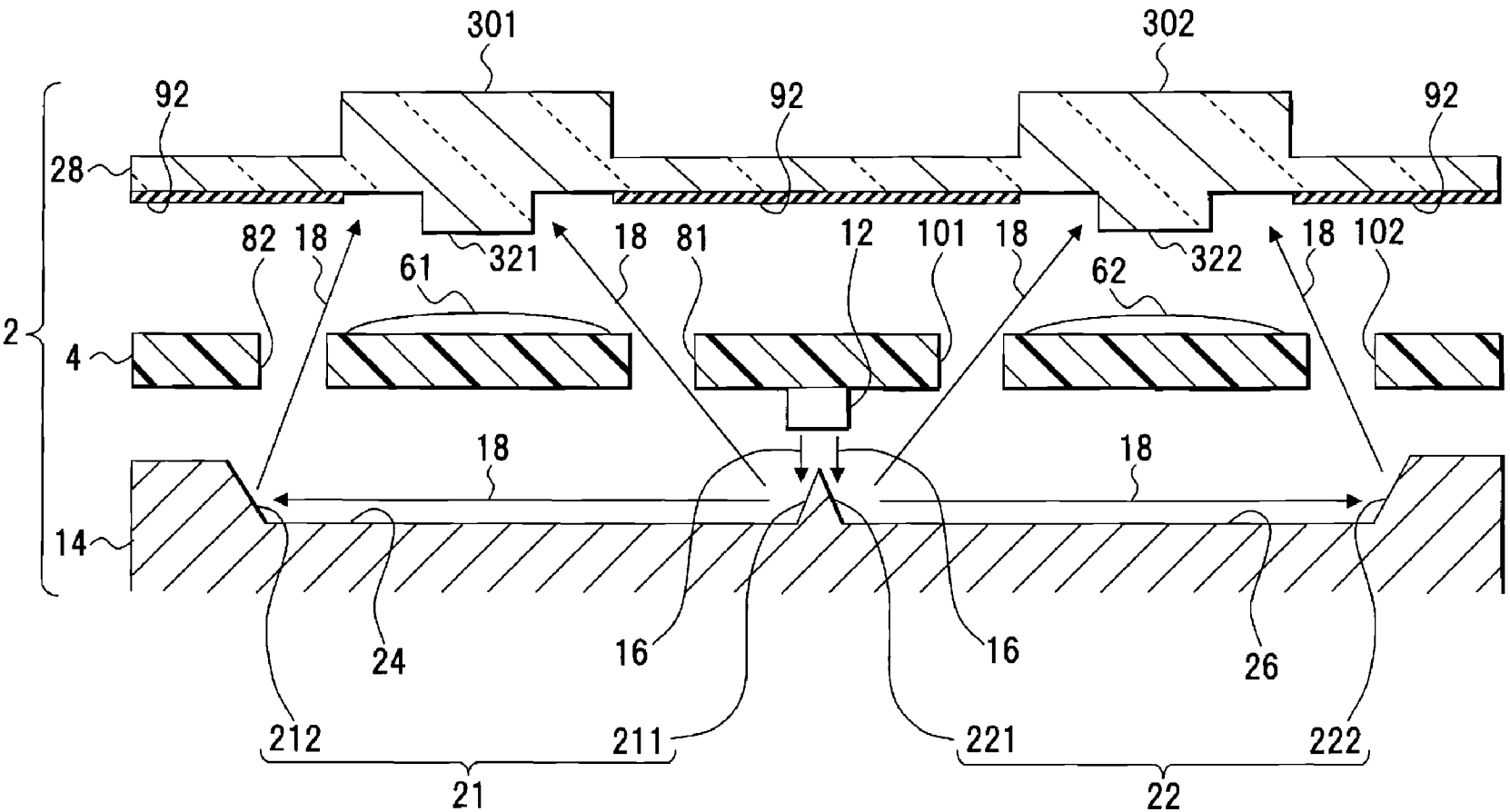
FIG. 7 is a diagram of other embodiments of an illuminating structure and an illuminating method of a key operating unit.

The keypad unit 28 may have a light-shielding unit 92 formed on the back surface side as depicted in FIG. 7 to selectively shield the reflected light 18.

Figure 8:
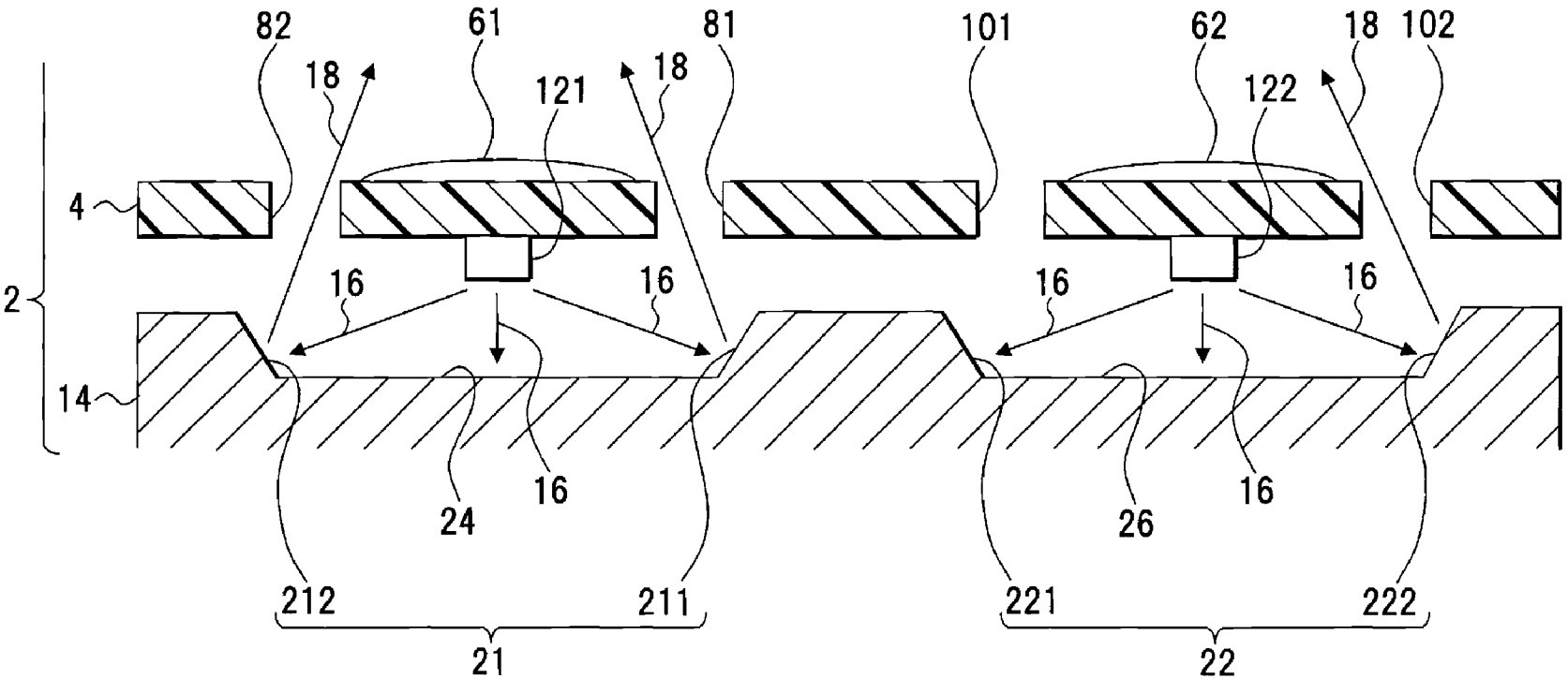
FIG. 8 is a diagram of other embodiments of an illuminating structure and an illuminating method of a key operating unit.

Although the single light-emitting element 12 is disposed for the reflecting portions 21 and 22, light-emitting elements 121 and 122 may be disposed for the respective reflecting portions 21 and 22 as depicted in FIG. 8.

Examples

A portable apparatus that is an example of the illuminating structure or the illuminating method of the key operating unit described above will be described with reference to FIGS. 9, 10, 11, 12, 13, 14, 15, 16, 17 and 18.

Figure 9:
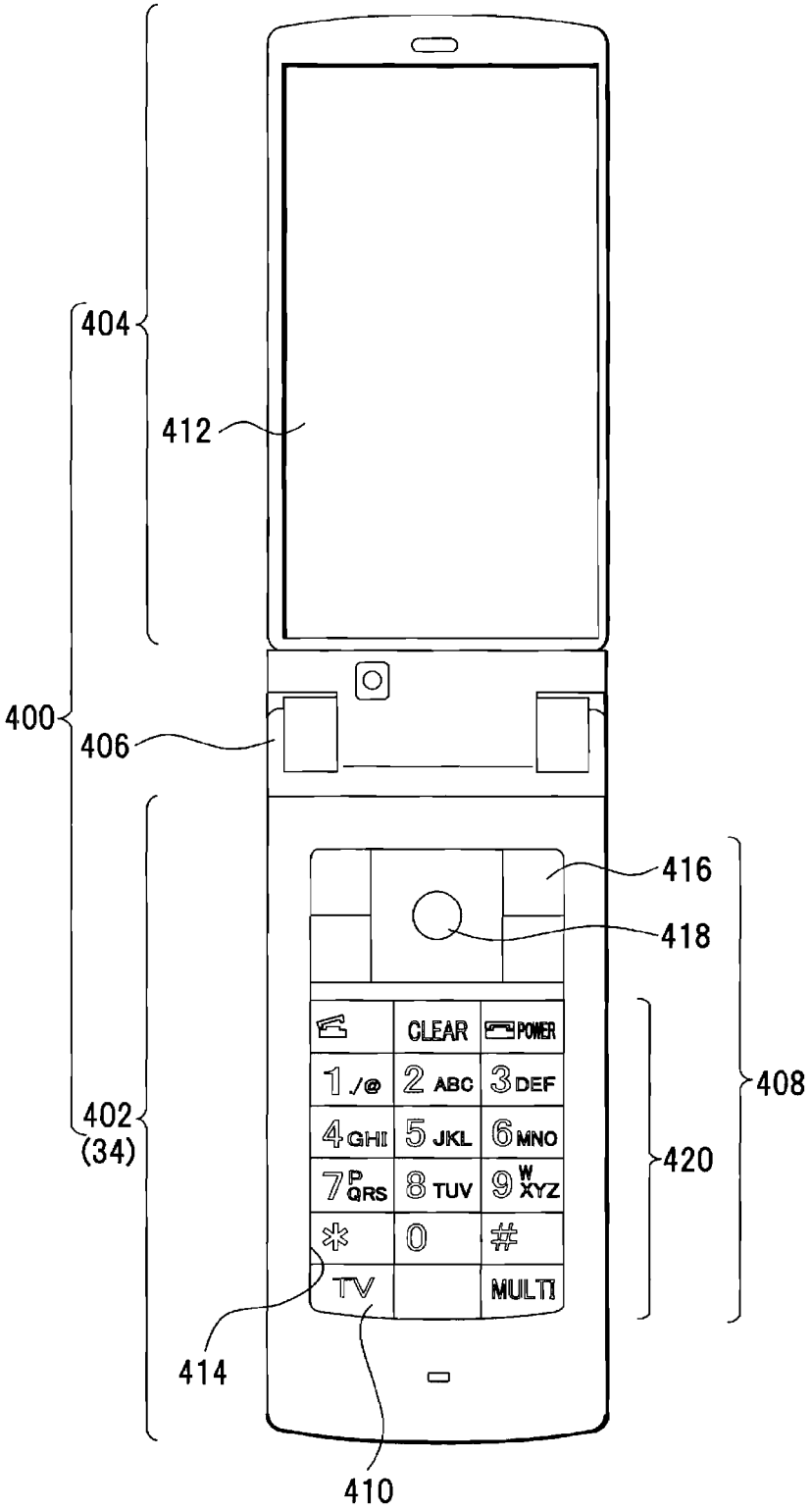
FIG. 9 is a diagram of a portable apparatus that is an example of an illuminating structure and an illuminating method of a key operating unit.
Figure 10:
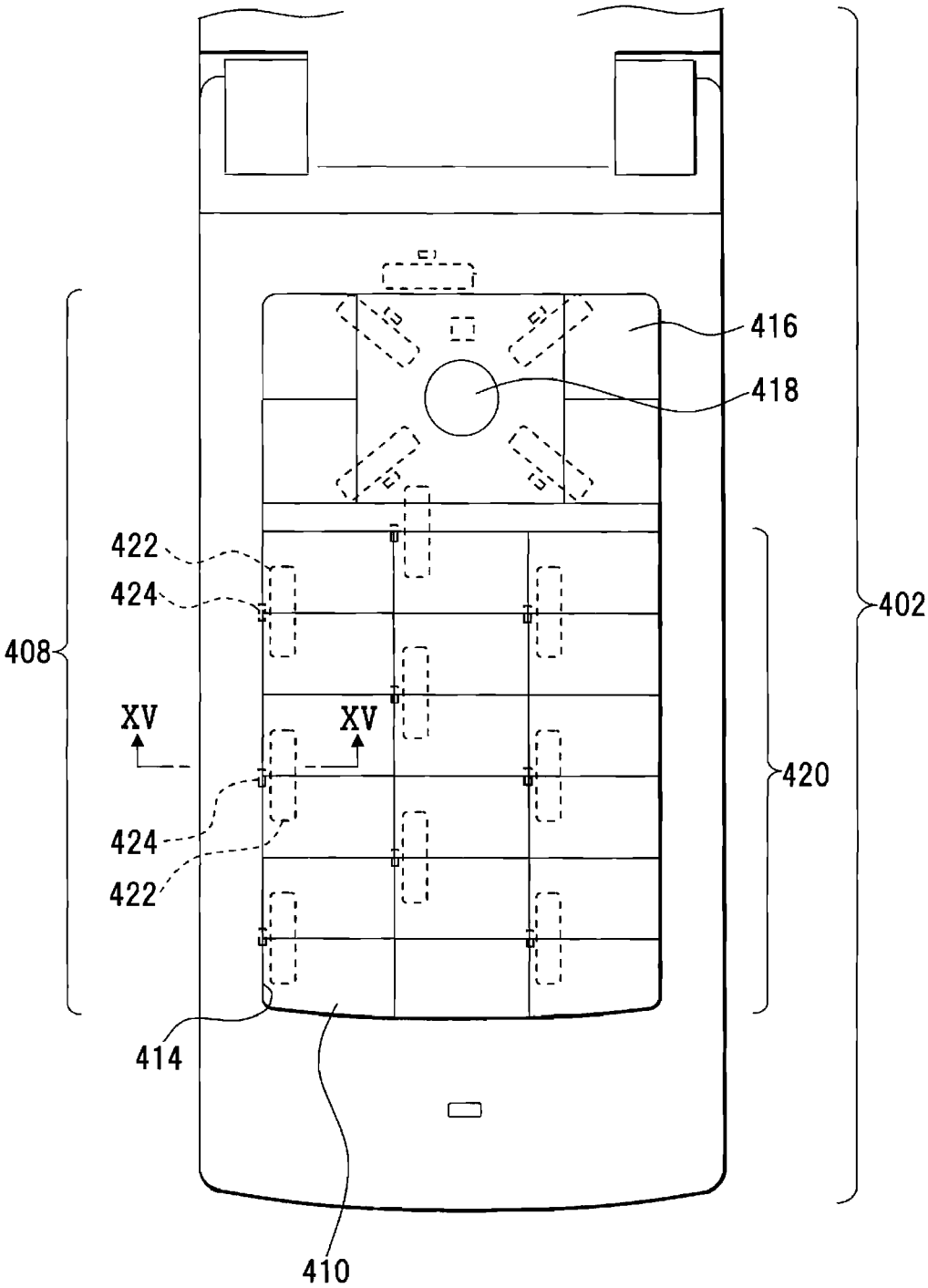
FIG. 10 is a diagram of a housing unit of the portable apparatus with light-emitting elements and light-guiding window portions depicted in an overlapped manner.
Figure 11:
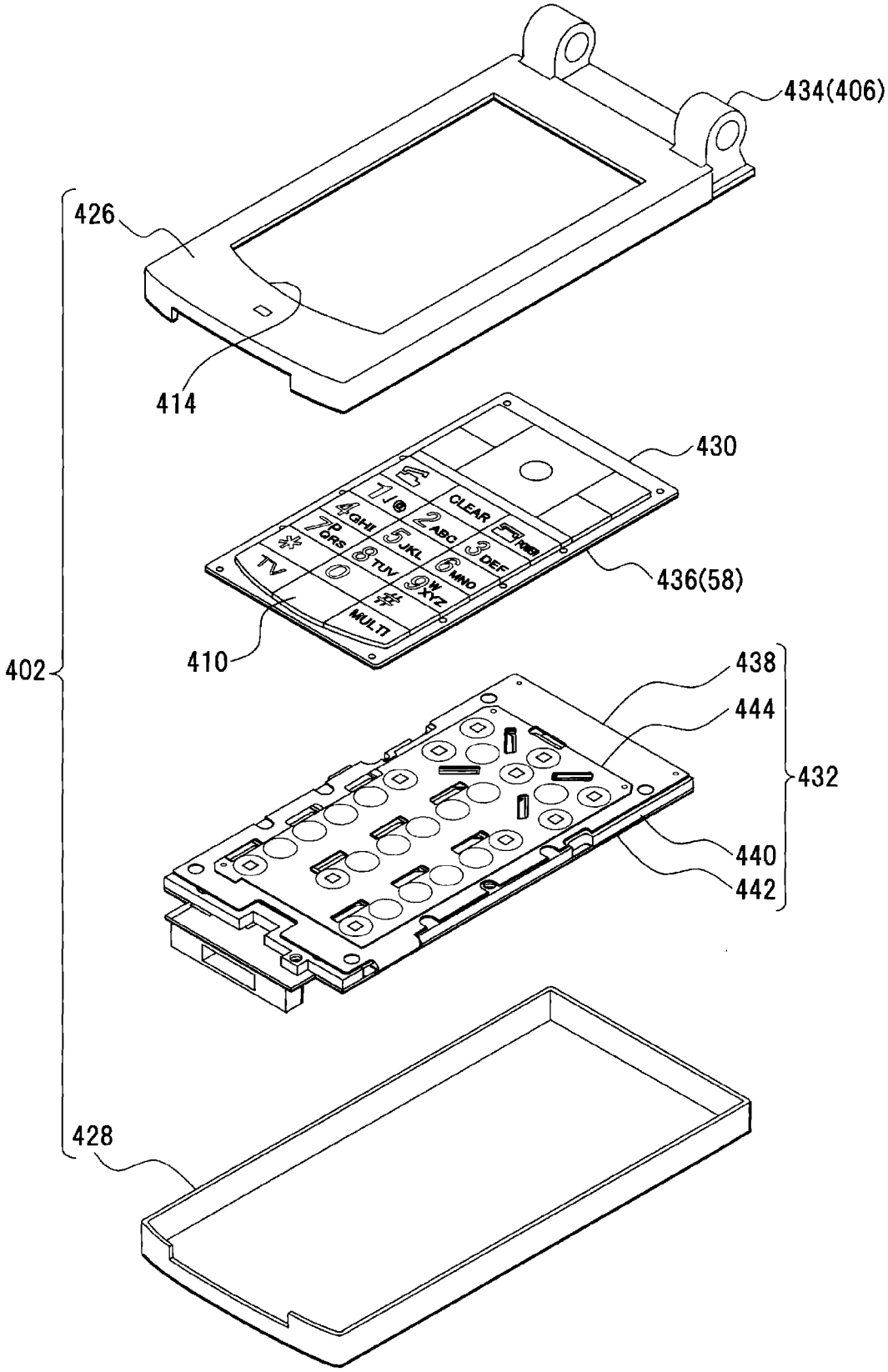
FIG. 11 is an exploded perspective view of the housing unit of the portable apparatus depicted in an exploded manner.
Figure 12:
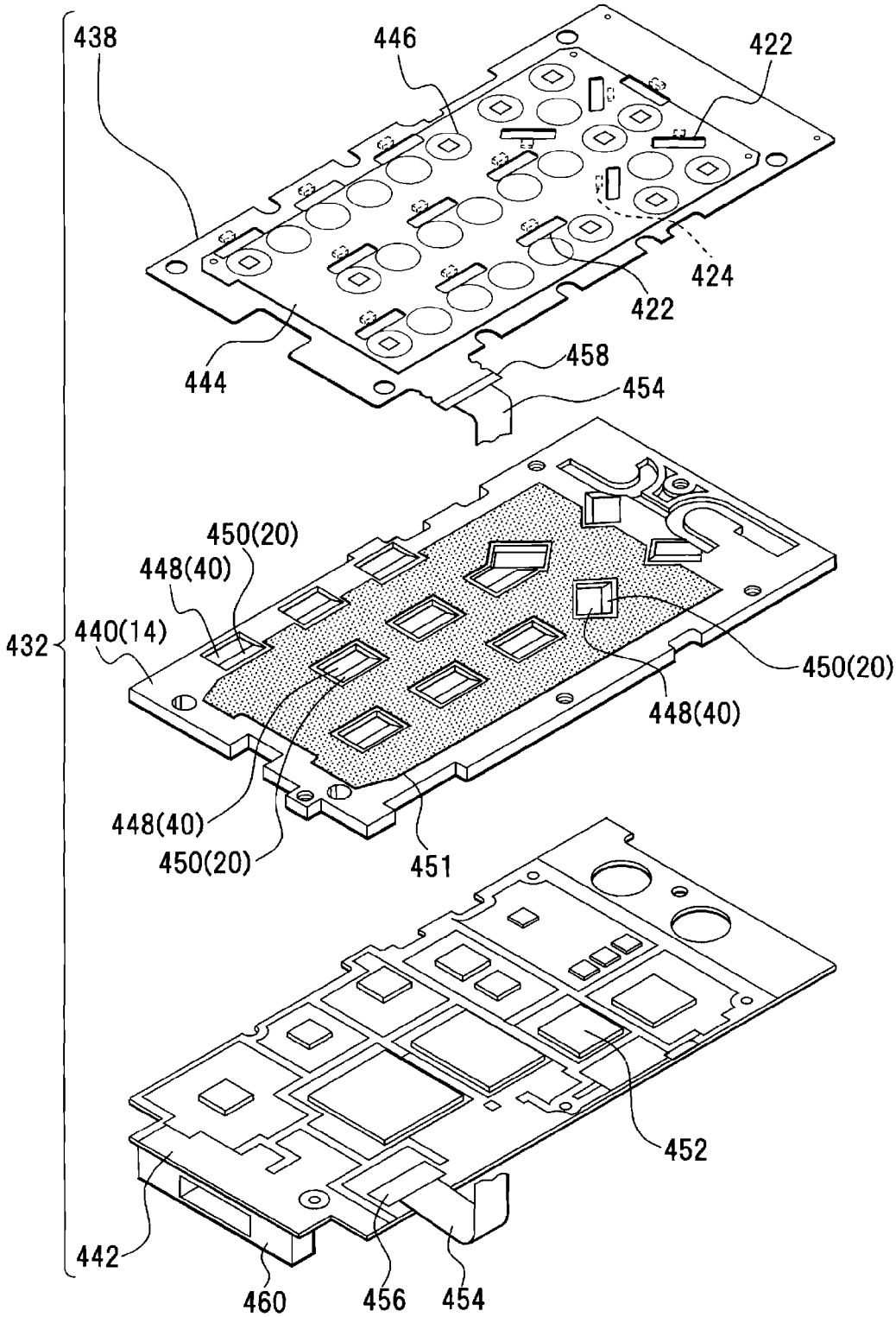
FIG. 12 is an exploded perspective view of a substrate unit depicted in an exploded manner.
Figure 13:
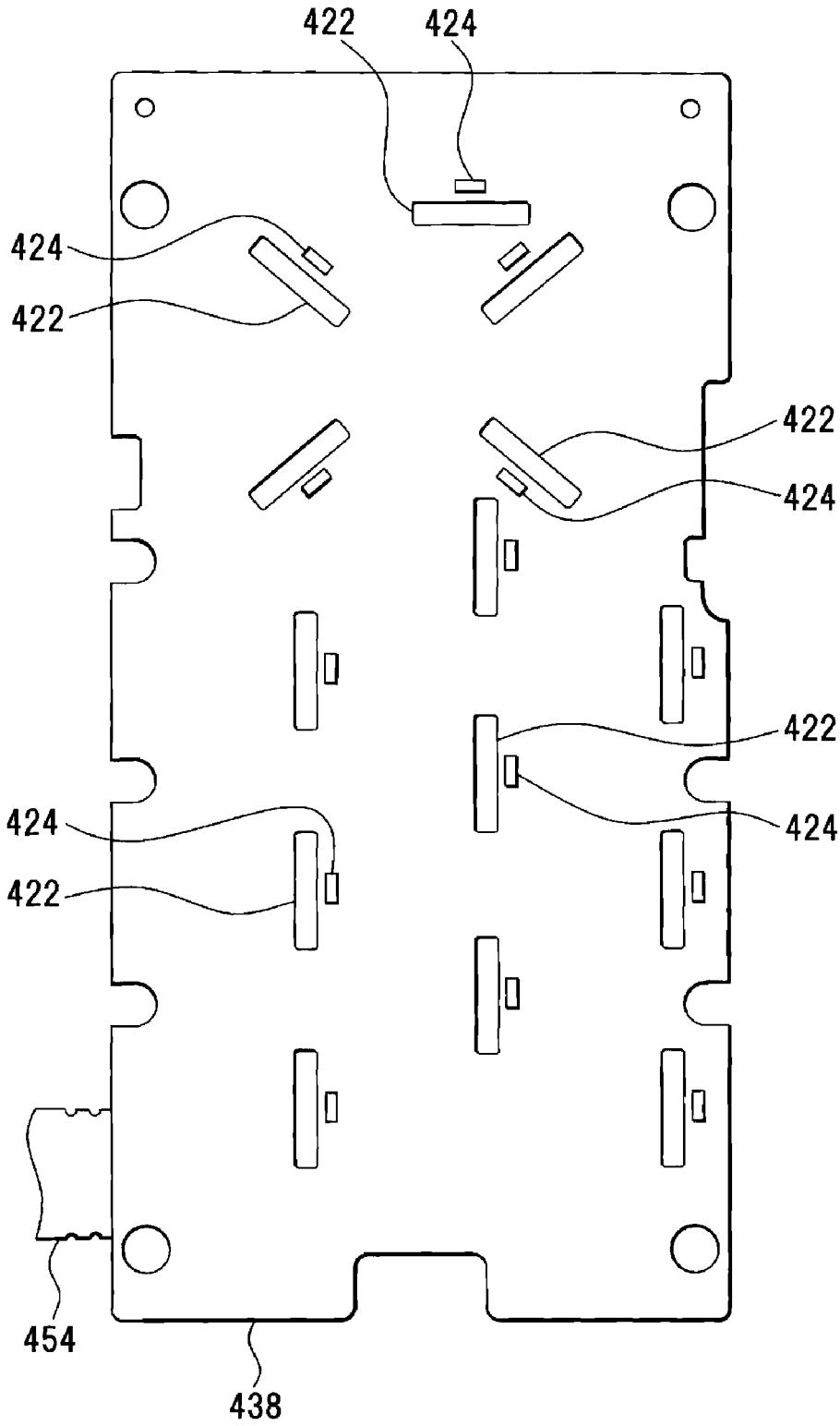
FIG. 13 is a diagram of the back surface side of a key flexible substrate.
Figure 14:
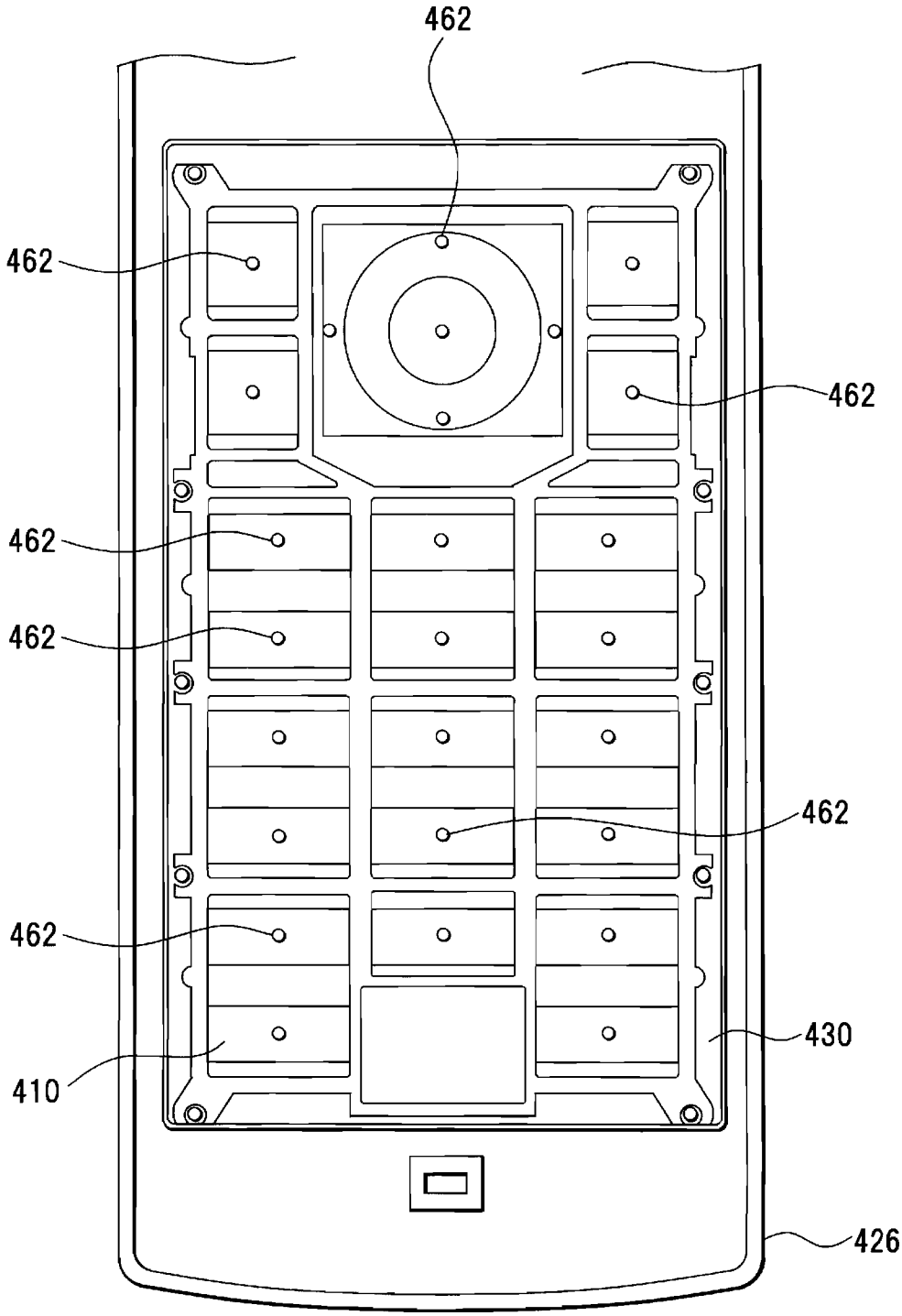
FIG. 14 is a diagram of the housing unit viewed from the back surface side of the keypad unit.
Figure 15:
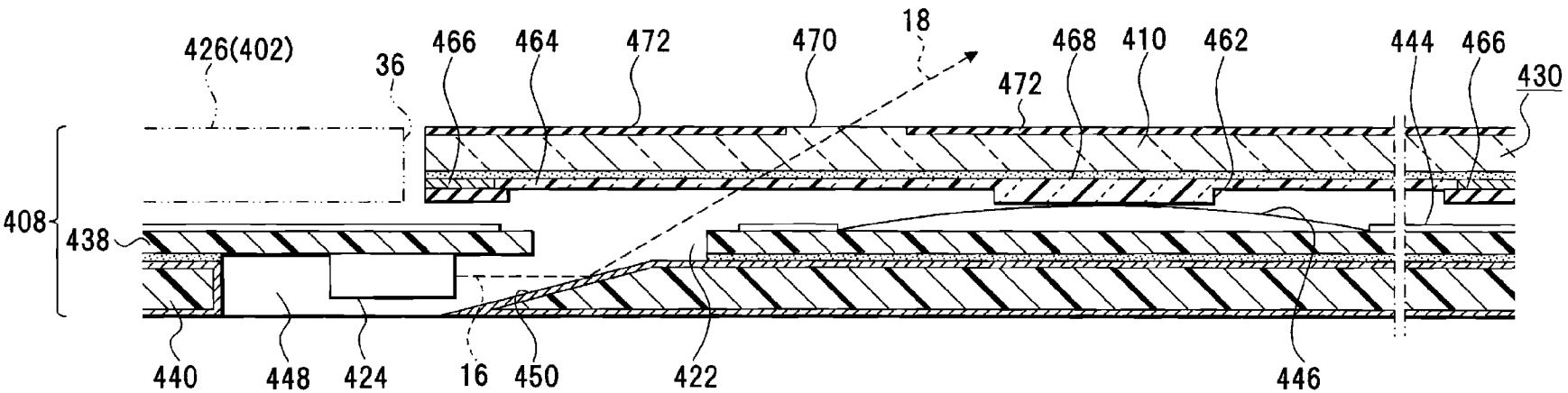
FIG. 15 is a cross-section diagram taken along line XV-XV of FIG. 10.
Figure 16:
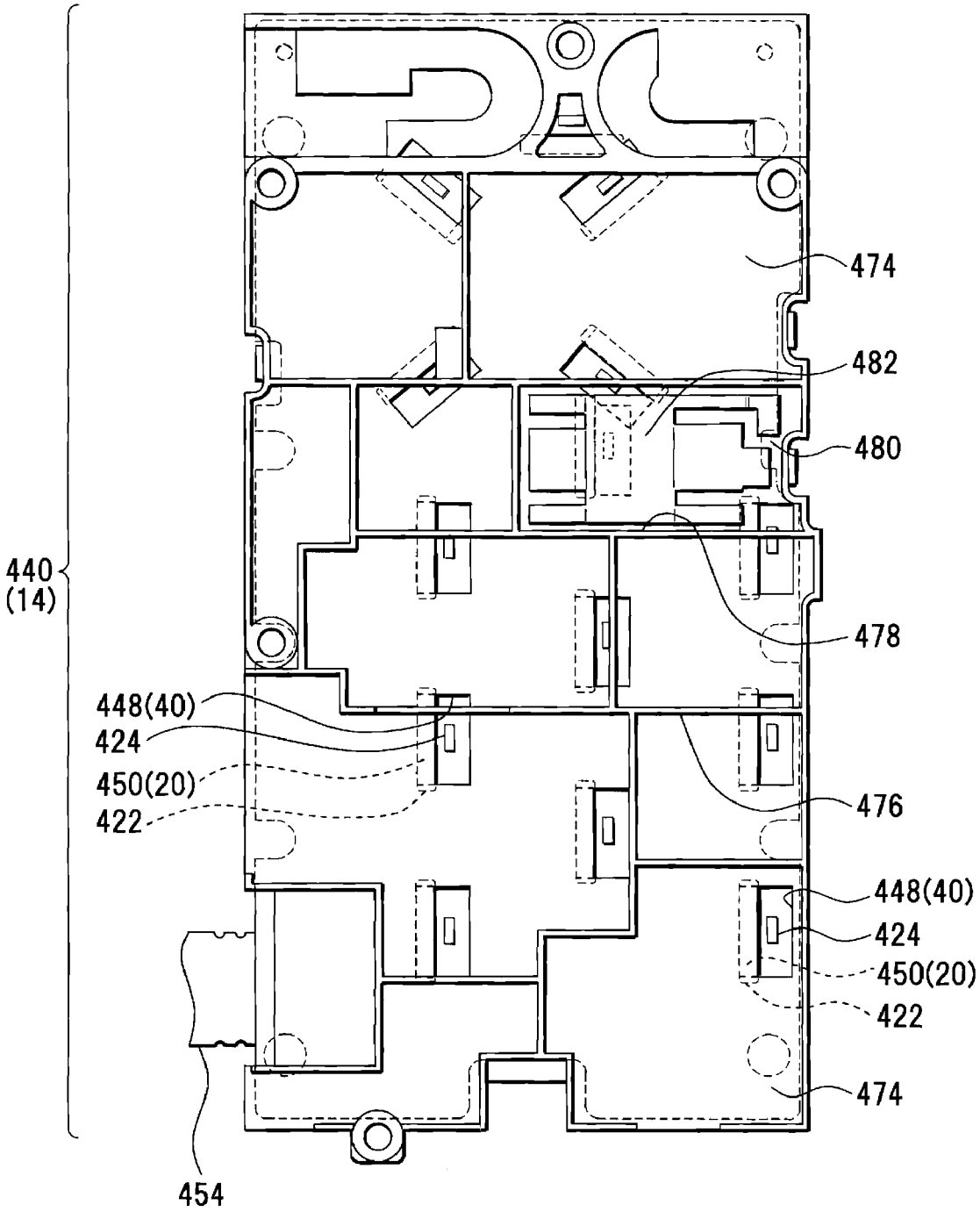
FIG. 16 is a diagram of a shield case unit.
Figure 17:
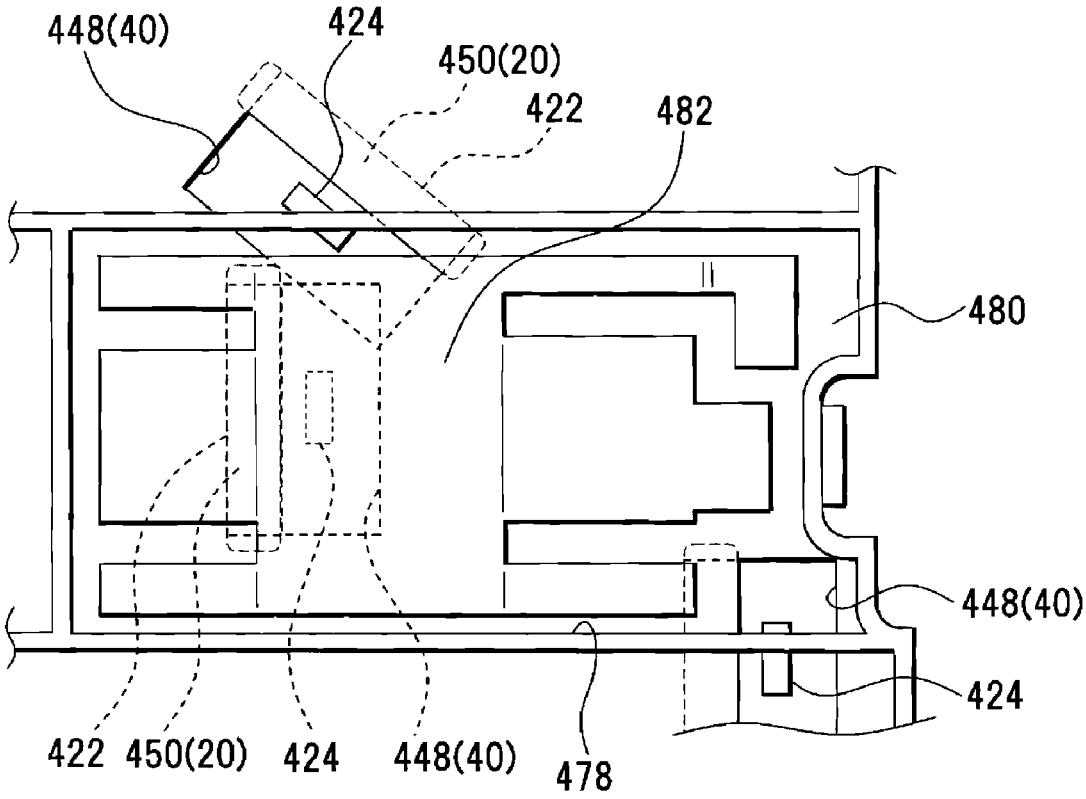
FIG. 17 is a diagram of a portion of the shield case unit.
Figure 18:
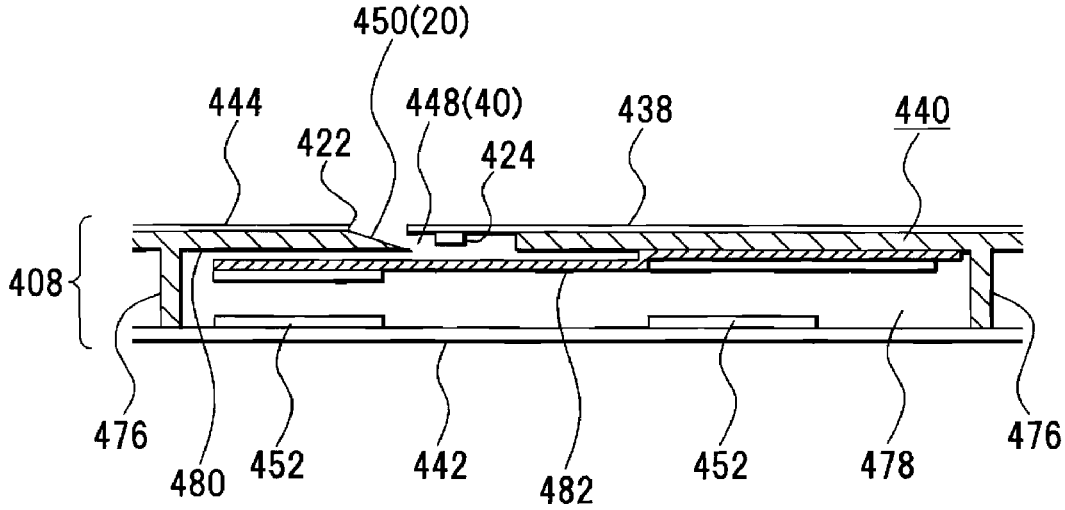
FIG. 18 is a cross-section diagram of a space unit of the shield case unit.

FIG. 9 depicts a portable apparatus; FIG. 10 depicts arrangement of the light-guiding window portion and the light-emitting element in the key operating unit; FIG. 11 is an exploded perspective view of the housing unit of the portable apparatus; FIG. 12 is an exploded perspective view of a substrate unit; FIG. 13 depicts a key-flexible from the back surface side; FIG. 14 depicts the keypad unit from the back surface side; FIG. 15 is a cross-section diagram taken along line XV-XV of FIG. 10; FIG. 16 depicts a shield case unit; FIG. 17 depicts a multi-shield unit of the shield case unit and FIG. 18 depicts a shield structure of the multi-shield unit depicted in FIG. 17. In FIGS. 9 to 18, the portions same as or common to FIGS. 2 to 6 are denoted by the same reference numerals and explicitly described as the same or common portions.

This example corresponds to the second embodiment. As depicted in FIG. 9, a portable apparatus 400 has a first housing unit 402 and a second housing unit 404 coupled by a hinge unit 406 and is configured such that the housing units 402 and 404 can be opened and closed around the hinge unit 406. The housing unit 402 is a fixed side and includes a key operating unit 408, and the key operating unit 408 includes a plurality of key top portions 410 assigned with cursor keys, a decision key, a numeric keypad, etc. The housing unit 404 is a display side and is disposed with an LCD (liquid crystal display) displaying device 412. The above illuminating structure is used for the key operating unit 408.

A key window portion 414 is formed in the housing unit 402 and a plurality of the key top portions 410 of the key operating unit 408 is inserted into the key window portion 414. The key top portions 410 are made up of, for example, cursor keys 416, a decision key 418, and a numeric keypad 420.

As depicted in FIG. 10, the key operating unit 408 is disposed with pluralities of light-guiding window portions 422 and light-emitting elements 424 corresponding to a plurality of the key top portions 410. In this example, the light-guiding window portion 422 is formed across the two adjacent key top portions 410 and the light-emitting element 424 corresponding to this light-guiding window portion 422 is disposed as in the case of the second embodiment.

As depicted in FIG. 11, the housing unit 402 includes an upper-surface-side housing 426 and a back-surface-side housing 428 and is a molded body made of a synthetic resin subjected to an opaquing process, for example, and a keypad unit 430 including the key top portions 410 and a substrate unit 432 are disposed within the housing unit 402.

In the upper-surface-side housing 426, a bearing potion 434 of the hinge unit 406 is formed and the key window portion 414 is also formed. The key top portions 410 of the keypad unit 430 are inserted into the key window portion 414. An elastic supporting unit 436 is disposed on the back surface side of the keypad unit 430. The elastic supporting unit 436 corresponds to the elastic supporting unit 58 (FIG. 5) described above.

The substrate unit 432 has a three-layer structure consisting of a key-flexible 438, a shield case unit 440 and a circuit substrate 442, and a dome sheet 444 is disposed on the upper surface of the key-flexible 438.

As depicted in FIG. 12, the light-guiding window portions 422 are formed in the key-flexible 438 and the dome sheet 444; a plurality of key dome portions 446 are formed in the dome sheet 444; and the light-emitting elements 424 are arranged near the light-guiding window portions 422 on the back surface of the key-flexible 438.

The shield case unit 440 makes up the illuminating plate 14 (FIG. 5) described above and has recess portions 448 formed correspondingly to the light-guiding window portions 422, and reflecting portions 450 are formed on the inner wall portions of the recess portions 448. The recess portions 448 corresponds to the recess portion 40 (FIG. 5) described above and the reflecting portions 450 corresponds to the reflecting portion 20 (FIG. 5) described above. A bonding layer 451 such as a double-faced adhesive tape or an adhesive is formed on the upper surface of the shield case unit 440 except the recess portions 448 and the bonding layer 451 bonds the key-flexible 438.

The circuit substrate 442 is an example of a circuit device, and IC (integrated circuit) chips 452 and various electronic components are mounted as functional units of the circuit device on the circuit substrate 442. A cable 454 is connected to a connector 456 and a connector 458. A connector 460, etc., for external connection are disposed on the circuit substrate 442 side.

As depicted in FIG. 13, the light-guiding window portions 422 and the light-emitting elements 424 are arranged on the back surface side of the key-flexible 438. As depicted in FIG. 14, projecting portions 462 are formed at the positions corresponding to the centers of the key dome portions 446 of the dome sheet 444 depicted in FIG. 12 on the back surface side of the keypad unit 430. When the key top portion 410 is pressed down, the projecting portion 462 at the center of the key dome portion 446 is pressed down and the key switch is operated.

As depicted in FIG. 15, the light-emitting element 424 disposed on the back surface side of the key-flexible 438 is inserted in the recess portion 448 of the shield case unit 440 in the key operating unit 408. The outgoing light 16 of the light-emitting element 424 is reflected by the reflecting portion 450 and the reflected light 18 thereby is applied to the key top portion 410 of the keypad unit 430 through the light-guiding window portion 422 of the key-flexible 438.

The keypad unit 430 includes an elastic supporting unit 464 and a suspension 466 as in the second embodiment and the key top portion 410 is bonded by a bonding layer 468 to the elastic supporting unit 464. The key top portion 410 includes a light transmitting unit 470 and a light-shielding unit 472.

As depicted in FIG. 16, on the back surface portion of the shield case unit 440, a plurality of space units 474 is formed by shield walls 476 as surrounding wall units corresponding to the functional units mounted on the circuit substrate 442, and the functional units of the circuit device are disposed in the respective space units 474 to shield each of the functional units.

In this example, as depicted in FIGS. 17 and 18, a shield plate 482 is disposed on the side of a ceiling portion 480 in a space unit 478, which is one of a plurality of the space units 474, and the multiplexed shielding is achieved by the shield plate 482 in addition to the shielding of the shield case unit 440. The IC chips 452 making up the functional units disposed on the circuit substrate 442 are shielded by the ceiling portion 480 of the shield case unit 440, the shield walls 476 and the shield plate 482. Although the light-guiding window portion 422 is formed in the ceiling portion 480 of the space unit 478, since the shield plate 482 is disposed, the shielding effect can be prevented from deteriorating due to the formation of the light-guiding window portion 422.

In such an example, the outgoing light 16 of the light-emitting element 424 is reflected by the reflecting portion 450 and the reflected light passing through the light-guiding window portions 422 is applied to a key top portion not depicted as in the second embodiment. Since the light-emitting element 424 is disposed at the intermediate point between adjacent key top potions and the light-guiding window portion 422 and the reflecting portion 450 are formed across the adjacent key top potions, the key top potions are uniformly illuminated by the reflected light, i.e., indirect light from the outgoing light of the light-emitting element 424. Since the number of the light-emitting elements is reduced and the key operating unit 408 is flattened as in the case of the above embodiments, the housing unit 402 of the portable apparatus 400 is flattened to contribute to the miniaturization of the portable apparatus 400.

Figure 19:
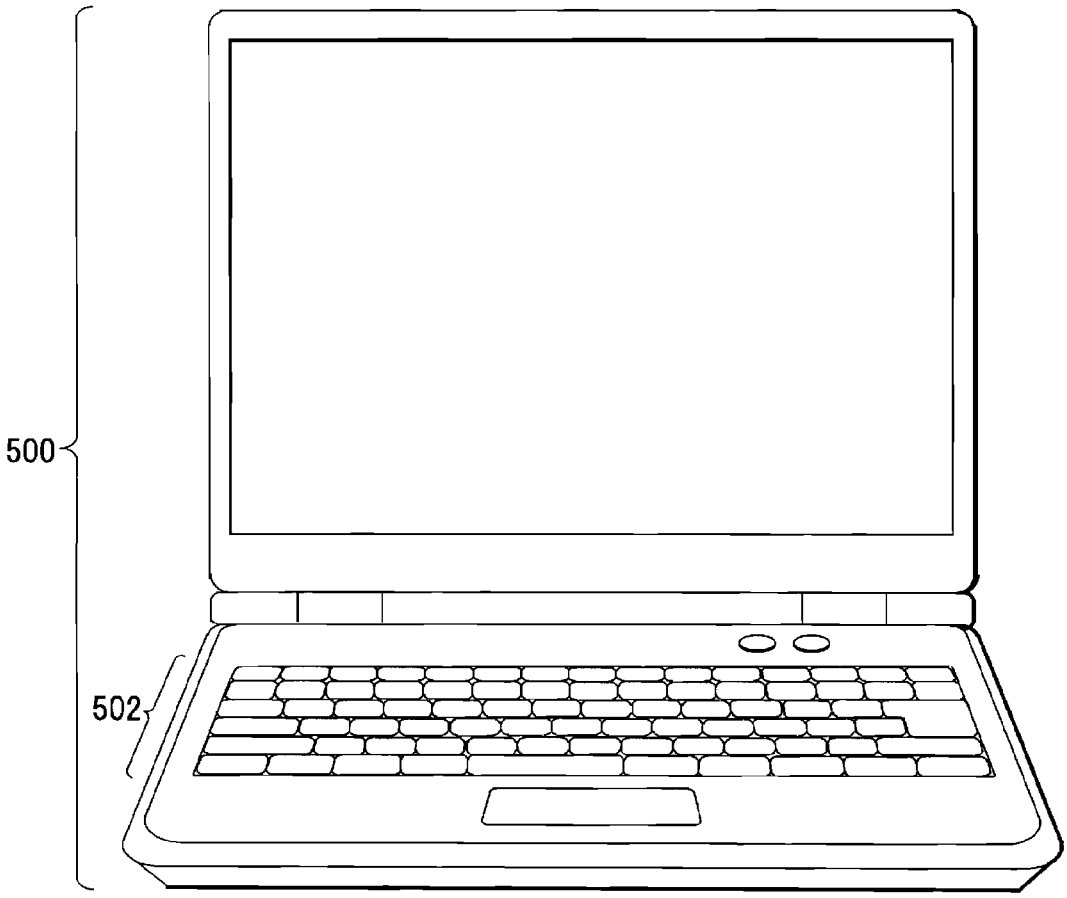
FIG. 19 is a diagram of a personal computer that is another example to which an illuminating structure and an illuminating method of a key operating unit are applied.
Figure 20:
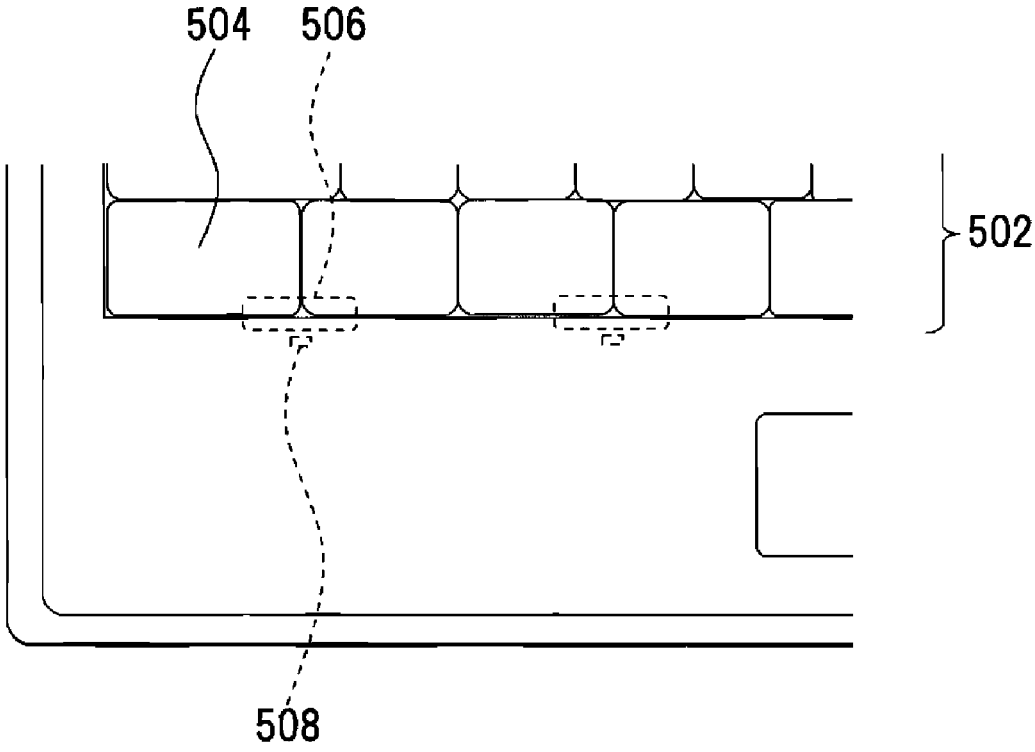
FIG. 20 is a diagram of a portion of the key operating unit with light-emitting elements and light-guiding window portions depicted in an overlapped manner.

Although the portable apparatus 400 is exemplarily illustrated in the above example, the present invention may be applicable to an electronic apparatus such as a personal computer (PC) 500 as depicted in FIG. 19. As depicted in FIG. 20, a light-guiding window portion 506 and a light-emitting element 508 are disposed across a plurality of key top potions 504 of a key operating unit 502 in the PC 500. The light-emitting element 508 is disposed on the back surface side of a key-flexible not depicted and can be inserted and disposed in a recess portion of a shield case unit as above. Therefore, the light-emitting elements 508 of the key operating unit 502 can be reduced and the flattening of the key operating unit can be achieved to contribute to the miniaturization of the PC.

Figure 21:
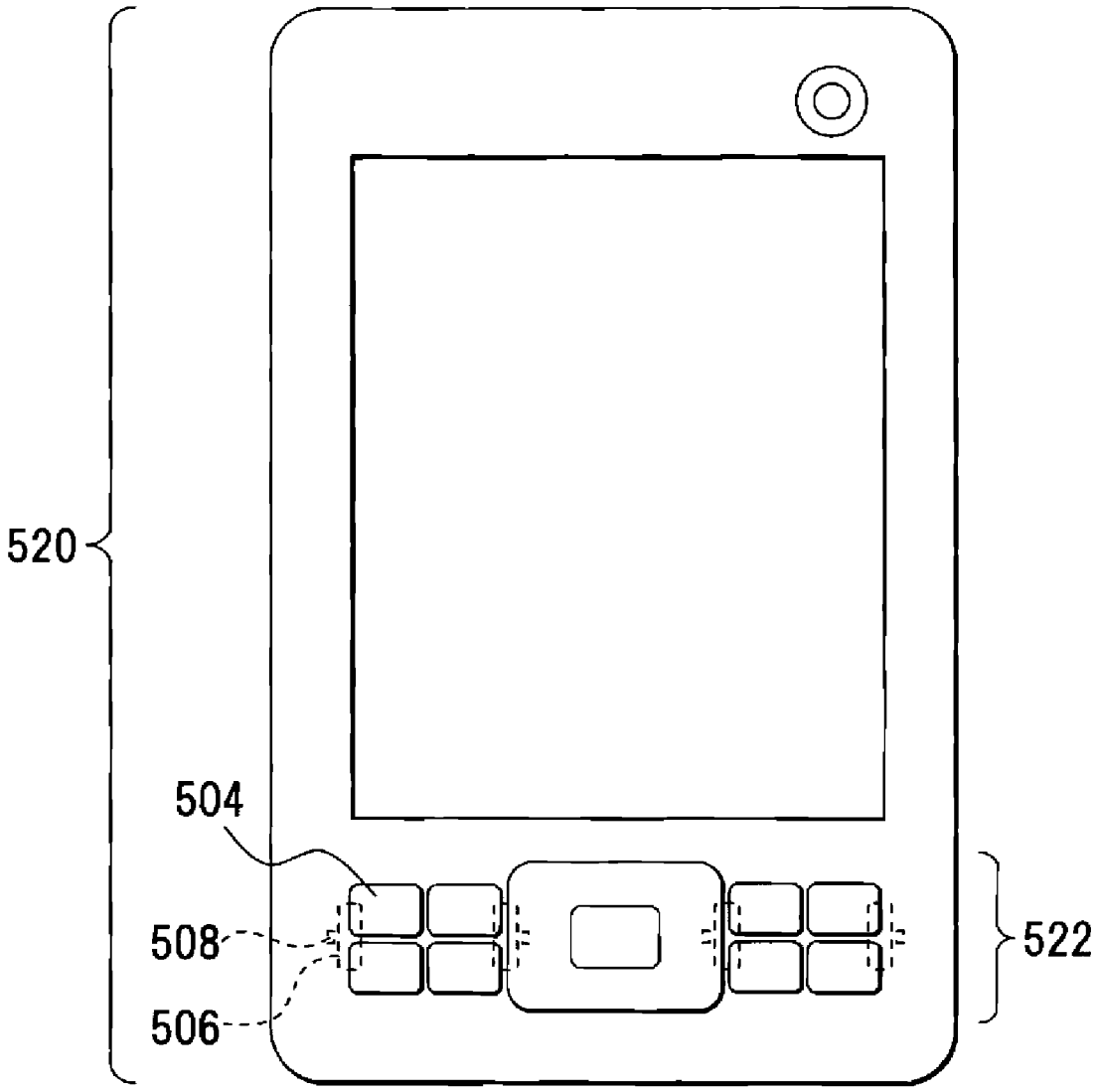
FIG. 21 is a diagram of a portable information terminal machine that is another example to which an illuminating structure and an illuminating method of a key operating unit are applied.

The present invention may be applied to a key operating unit 522 of an electronic apparatus, for example a personal digital assistant (PDA) 520 as depicted in FIG. 21. In this case, the light-guiding window portion 506 and the light-emitting element 508 are disposed across a plurality of the key top potions 504 of the key operating unit 522 in the same way. In this case, the light-emitting element 508 is disposed on the back surface side of a key-flexible not depicted and can be inserted and disposed in a recess portion of a shield case unit. Therefore, the light-emitting elements 508 of the key operating unit 502 can be reduced and the flattening of the key operating unit and the miniaturization of the PDA can be achieved to acquire the same effects as the above embodiments.

Although a portable apparatus, a PC and a PDA are exemplarily illustrated as the examples of the present invention, the present invention is applicable to any devices including a key operating unit for operating a plurality of key switches and is applicable to game devices, cameras, video devices, etc.

Technical ideas are then enumerated that are extracted from the embodiments described above. The technical ideas according to the present invention, from superordinate concepts to subordinate concepts, can be grasped at various levels and in various variations and the present invention is not limited to the following description.

An illuminating structure of a key operating unit for operating a key switch includes a housing unit having a window portion formed correspondingly to the key switch; a circuit substrate provided inside the housing unit, disposed with the key switch, and provided with a light-guiding window portion; a keypad unit that includes a key top portion inserted in the window portion of the housing unit, the keypad unit including a light-guiding portion at least in the key top portion; a light-emitting element arranged on the back surface side of the circuit substrate; and an illuminating plate that has a reflecting portion reflecting outgoing light of the light-emitting element to apply the reflected light from the reflecting portion to the keypad unit through the light-guiding window portion of the circuit substrate.

According to such configuration, since the outgoing light of the light-emitting element disposed on the back surface portion of the circuit substrate is applied to the reflecting portion of the illuminating plate and the reflected light of the reflecting portion passes through the light-guiding window portion of the circuit substrate and arrives at the keypad unit, the keypad unit is illuminated by the indirect light.

In the illuminating structure of the key operating unit, preferably, the reflecting portion may include a reflecting surface across a plurality of the key top portions and may apply the reflected light to a plurality of the key top portions by the reflecting surface. According to such configuration, the key top portions can be illuminated with the fewer light-emitting elements than the key top portions and the efficient illuminating structure is achieved.

In the illuminating structure of the key operating unit, preferably, the illuminating plate may include a recess portion and may include the reflecting portion in the recess portion. According to such configuration, since the reflecting portion is disposed in the recess portion of the illuminating plate, the flattening of the illuminating structure is achieved.

In the illuminating structure of the key operating unit, preferably, the light-emitting element may be inserted in the recess portion. According to such this configuration, since the light-emitting element is inserted into the recess portion of the illuminating plate, the flattening of the illuminating structure is achieved in such a way that an interval between the circuit substrate and the illuminating plate can be narrowed.

The illuminating structure of the key operating unit may preferably include a dome sheet covering the key switch, or include a light-guiding window portion that allows passage of the reflected light through the dome sheet, or include a projecting portion corresponding to a key dome of the dome sheet on the back surface portion of the keypad unit.

In the illuminating structure of the key operating unit, preferably, the illuminating plate may make up a shield case unit of a circuit device disposed on the back surface side of the illuminating plate. According to such configuration, since the shield case unit is formed as a shield member by using a metal plate or a metal plating process, metal deposition, etc., for a synthetic resin case unit to take a measure against noise, the shield case unit can be used as the illuminating plate or the reflecting portion thereof, and the reflection efficiency of the outgoing light of the light-emitting element is enhanced to acquire an illuminance for the illuminating light for the keypad unit.

The illuminating structure of the key operating unit may preferably include a surrounding wall portion that surrounds a functional unit of the circuit device on the side portion of the back surface of the illuminating plate, or in the illuminating structure of the key operating unit, a shield member shielding the circuit substrate side and the functional unit may be disposed in a space unit surrounded by the surrounding wall. According to such configuration, the shield effect of the space unit surrounded by the surrounding wall is enhanced and, if the shield member is disposed, the shield effect can further be enhanced by multiplexing of the shield.

An electronic apparatus having a key operating unit of a key switch includes a housing unit having a window portion formed correspondingly to the key switch; a circuit substrate provided inside the housing unit, disposed with the key switch, and provided with a light-guiding window portion; a keypad unit that includes a key top portion inserted in the window portion of the housing unit, the keypad unit including a light-guiding portion at least in the key top portion; a light-emitting element arranged on the back surface side of the circuit substrate; and an illuminating plate that has a reflecting portion reflecting outgoing light of the light-emitting element to apply the reflected light from the reflecting portion to the keypad unit through the light-guiding window portion of the circuit substrate. This is the above illuminating structure of the key operating unit adapted to the electronic apparatus. According to such configuration, the uniform illumination effect, the flattening, the miniaturization, etc., of the key operating unit are achieved in the electronic apparatus due to the advantages of the above illuminating structure of the key operating unit.

A portable apparatus having a key operating unit of a key switch includes a housing unit having a window portion formed correspondingly to the key switch; a circuit substrate provided inside the housing unit, disposed with the key switch, and provided with a light-guiding window portion; a keypad unit that includes a key top portion inserted in the window portion of the housing unit, the keypad unit including a light-guiding portion at least in the key top portion; a light-emitting element arranged on the back surface side of the circuit substrate; and an illuminating plate that has a reflecting portion reflecting outgoing light of the light-emitting element to apply the reflected light from the reflecting portion to the keypad unit through the light-guiding window portion of the circuit substrate. This is the above illuminating structure of the key operating unit adapted to the portable apparatus such as a portable telephone. According to such configuration, the uniform illumination effect, the flattening, the miniaturization, etc., of the key operating unit are achieved in the portable apparatus due to the advantages of the illuminating structure of the key operating unit described above.

An illuminating method of a key operating unit for operating a key switch includes forming a window portion corresponding to the key switch in a housing unit; disposing the key switch and forming a light-guiding window portion on a circuit substrate provided inside the housing unit; forming a key top portion on a keypad unit for pressing down the key switch and inserting the key top portion in the window portion of the housing unit; arranging a light-emitting element on the back surface side of the circuit substrate; and forming a reflecting portion reflecting outgoing light of the light-emitting element to apply the reflected light acquired by the reflecting portion to the keypad unit through the light-guiding window portion of the circuit substrate. Such a method enables the uniform illumination to the key operating unit and contributes to the flattening of the key operating unit.

In the illuminating method of the key operating unit, preferably, the reflecting portion may include a reflecting surface across a plurality of key top portions and may apply the reflected light to a plurality of the key top portions by the reflecting surface.

In the illuminating method of the key operating unit, preferably, a recess portion may be formed in the illuminating plate; the reflecting portion may be formed in the recess portion; and the light-emitting element may be inserted in the recess portion.

According to the embodiments, the following effects can be acquired.

(1) Since the light-emitting element is disposed on the back surface side of the circuit substrate arranged with the key switches, the keypad unit can be placed closer to the disposition surface of the key switches of the circuit substrate and the flattening can be achieved in the illuminating structure of the key operating unit.

(2) Since the light-emitting element disposed on the back surface side of the circuit substrate is hidden by the circuit substrate to reflect the light emitted from the light-emitting element by the reflecting portion of the illuminating plate and the reflected light arrives at the keypad unit through the light-guiding window portion of the circuit substrate so that only indirect light is applied to the keypad unit, the uniform illumination can be acquired and an eyeball-like shape due to the direct light can be prevented.

(3) Since the light of the light-emitting element can be reflected and applied to a plurality of the key top portions when the reflecting portion having the reflecting surface across a plurality of the key top portions is included, the key top portions can be illuminated with the fewer light-emitting elements than the key top portions and the uniform illumination can be acquired with the fewer light-emitting elements.

(4) When the reflecting portion is formed in the recess portion formed in the illuminating plate, the flattening of the illuminating structure of the key operating unit can be achieved in such away that the reflecting portion can be formed in the surface of the illuminating plate.

(5) When the light-emitting element on the circuit substrate side is inserted in the recess portion formed in the illuminating plate, the flattening of the illuminating structure of the key operating unit can be achieved in such a way that the light-emitting element can be disposed in the surface of the illuminating plate.

(6) When the illuminating plate is disposed with the reflecting portion common to a plurality of the light-emitting elements corresponding to a plurality of the key operating units, the number of the light-emitting elements can be reduced.

(7) When such an illuminating structure or an illuminating method is used, the miniaturization and the flattening of a portable apparatus and an electronic apparatus can be achieved.

Although the most preferred embodiments, examples, etc., have been described as above, the present invention is not limited to the description and may variously be modified or altered by those skilled in the art based on the spirits of the present invention described in claims or disclosed herein of course and it is needless to say that such modifications and alterations fall within the present invention.

Since the light-emitting element is disposed on the back surface side of the circuit substrate arranged with the key switches, the keypad unit can be placed closer to the disposition surface of the key switches of the circuit substrate and the flattening can be achieved in the illuminating structure of the key operating unit; since the light-emitting element is hidden on the back surface side of the circuit substrate and the light emitted from the light-emitting element is reflected by the reflecting portion of the illuminating plate and the reflected light arrives at the keypad unit through the light-guiding window portion of the circuit substrate so that only indirect light is applied to the keypad unit, the uniform illumination can be acquired and an eyeball-like shape due to the direct light can be prevented; and therefore the present invention is useful.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that the various changes, substitutions, and alterations could be made hereto without departing from the spirit and scope of the invention.

What is claimed is:

1. An illuminating structure of a key operating unit for operating a key switch, comprising:

a housing unit to have a window portion formed correspondingly to the key switch;

a circuit substrate to be provided inside the housing unit, to be disposed with the key switch, and to be provided with a light-guiding window portion;

a keypad unit to include a plurality of key top portions inserted in the window portion of the housing unit, the keypad unit including a light-guiding portion at least in a plurality of the key top portions;

a light-emitting element to be arranged on a back surface side of the circuit substrate; and an illuminating plate to have a reflecting portion, having a reflecting surface across a plurality of the key top portions, reflecting outgoing light of the light-emitting element by the reflecting surface to apply the reflected light from the reflecting portion to a plurality of the key top portions through the light-guiding window portion of the circuit substrate.

2. The illuminating structure of the key operating unit of claim 1, wherein the illuminating plate includes a recess portion and includes the reflecting portion in the recess portion.

3. The illuminating structure of the key operating unit of claim 2, wherein the light-emitting element is inserted in the recess portion.

4. The illuminating structure of the key operating unit of claim 1, further comprising a dome sheet to cover the key switch.

5. The illuminating structure of the key operating unit of claim 4, further comprising a light-guiding window portion to allow passage of the reflected light through the dome sheet.

6. The illuminating structure of the key operating unit of claim 4, further comprising a projecting portion corresponding to a key dome of the dome sheet on a back surface portion of the keypad unit.

7. The illuminating structure of the key operating unit of claim 1, wherein the illuminating plate makes up a shield case unit of a circuit device disposed on a back surface side of the illuminating plate.

8. The illuminating structure of the key operating unit of claim 7, further comprising a surrounding wall portion to surround functional units of the circuit device on a side portion of a back surface of the illuminating plate.

9. The illuminating structure of the key operating unit of claim 8, wherein a shield member shielding the circuit substrate side and the functional units is disposed in a space unit surrounded by the surrounding wall.

10. The illuminating structure of the key operating unit of claim 1, wherein the reflecting portion includes another reflecting surface to reflect the reflected light that is reflected by the reflecting surface.

11. The illuminating structure of the key operating unit of claim 1, wherein the illuminating plate is made of a shield member for shielding a noise.

12. An electronic apparatus having a key operating unit of a key switch, comprising:

a housing unit to have a window portion formed correspondingly to the key switch;

a circuit substrate to be provided inside the housing unit, to be disposed with the key switch, and to be provided with a light-guiding window portion;

a keypad unit to include a plurality of key top portions inserted in the window portion of the housing unit, the keypad unit including a light-guiding portion at least in a plurality of the key top portions;

a light-emitting element to be arranged on a back surface side of the circuit substrate; and an illuminating plate to have a reflecting portion, having a reflecting surface across a plurality of the key top portions, reflecting outgoing light of the light-emitting element by the reflecting surface to apply the reflected light from the reflecting portion to a plurality of the key top portions through the light-guiding window portion of the circuit substrate.

13. The electronic apparatus of claim 12, wherein the electronic apparatus is a portable apparatus.

14. An illuminating method of a key operating unit for operating a key switch, comprising:

forming a window portion corresponding to the key switch in a housing unit;

disposing the key switch and forming a light-guiding window portion on a circuit substrate provided inside the housing unit;

forming a plurality of key top portions on a keypad unit for pressing down the key switch and inserting a plurality of the key top portions in the window portion of the housing unit;

arranging a light-emitting element on a back surface side of the circuit substrate; and forming a reflecting portion, having a reflecting surface across a plurality of the key to portions, reflecting outgoing light of the light-emitting element by the reflecting surface to apply the reflected light acquired by the reflecting portion to a plurality of the key to portions through the light-guiding window portion of the circuit substrate.

15. The illuminating method of the key operating unit of claim 14, wherein a recess portion is formed in the illuminating plate and wherein the reflecting portion is formed in the recess portion.

16. The illuminating method of the key operating unit of claim 15, wherein the light-emitting element is inserted in the recess portion.

* * * * *

UNITED STATES PATENT AND TRADEMARK OFFICE

CERTIFICATE OF CORRECTION

PATENT NO. : 8,063,326 B2
APPLICATION NO. : 12/699109
DATED : November 22, 2011
INVENTOR(S) : Keisuke Igarashi et al.

It is certified that error appears in the above-identified patent and that said Letters Patent is hereby corrected as shown below:

Column 16, Line 43, In Claim 14, delete “key to” and insert -- key top --, therefor.

Column 16, Line 46, In Claim 14, delete “key to” and insert -- key top --, therefor.

Signed and Sealed this
Twenty-eighth Day of February, 2012

David J. Kappos

David J. Kappos
*Director of the United States Patent and Trademark Office*